US007614727B2

(12) United States Patent
Hori

(10) Patent No.: US 7,614,727 B2
(45) Date of Patent: Nov. 10, 2009

(54) LIQUID EJECTION HEAD, MANUFACTURING METHOD THEREOF, AND IMAGE FORMING APPARATUS

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 439 days.

(21) Appl. No.: 11/237,739

(22) Filed: Sep. 29, 2005

(65) Prior Publication Data

US 2006/0066677 A1 Mar. 30, 2006

(30) Foreign Application Priority Data

Sep. 30, 2004 (JP) ..... 2004-288791
Sep. 30, 2004 (JP) ..... 2004-288792

(51) Int. Cl.
*B41J 2/045* (2006.01)
*B41J 2/14* (2006.01)

(52) U.S. Cl. ..... 347/71; 347/50; 347/68; 347/70

(58) Field of Classification Search ..... 347/47, 347/50, 71, 85, 68, 70
See application file for complete search history.

(56) References Cited

U.S. PATENT DOCUMENTS 5,940,099 A 8/1999 Karlinski
6,439,702 B1 8/2002 Karlinski
6,481,074 B1 11/2002 Karlinski
6,616,270 B1 9/2003 Miyata et al.
6,739,026 B2 * 5/2004 Harajiri ..... 29/25.35
6,766,567 B2 7/2004 Karlinski
2003/0206218 A1 11/2003 Miyata et al.
2006/0055743 A1 * 3/2006 Kodama et al. ..... 347/68
2006/0061634 A1 * 3/2006 Hori ..... 347/71
2006/0250455 A1 * 11/2006 Kojima ..... 347/68

FOREIGN PATENT DOCUMENTS

JP 2000-289201 A 10/2000
JP 2003-512211 A 4/2003
JP 2003-136721 A 5/2003
WO WO-01/30577 A1 5/2001

* cited by examiner

*Primary Examiner*—Julian D Huffman
*Assistant Examiner*—Kar Yip
(74) *Attorney, Agent, or Firm*—Birch, Stewart, Kolasch & Birch, LLP

(57) ABSTRACT

The liquid discharge head comprises: a plurality of ejection ports which eject liquid; a plurality of pressure chambers which communicate respectively with the plurality of ejection ports; a plurality of piezoelectric elements which deform the plurality of pressure chambers respectively and are provided on a side of the pressure chambers opposite to a side on which the ejection ports are formed; a common liquid chamber which supplies the liquid to the plurality of pressure chambers and is formed on a side of the piezoelectric element opposite to the pressure chambers; and a plurality of electric wires which stand upright from and substantially perpendicular to a surface on which the piezoelectric elements are mounted, the electric wires passing through a partition wall of the common liquid chamber and being electrically connected to the piezoelectric elements, the electric wires being formed by inserting wiring material for forming the electric wires into holes provided in the partition wall of the common liquid chamber.

12 Claims, 16 Drawing Sheets

LIQUID EJECTION HEAD, MANUFACTURING METHOD THEREOF, AND IMAGE FORMING APPARATUS

BACKGROUND OF THE INVENTION

1. Field of the Invention

The present invention relates to a liquid ejection head, a manufacturing method thereof, and an image forming apparatus, and more particularly to a technique for connecting electric wires provided at a high density in a liquid ejection head.

2. Description of the Related Art

An inkjet printer (inkjet recording apparatus) having an inkjet head (liquid ejection head) in which a large number of nozzles (ejection ports) are arranged is known as an image forming apparatus. This inkjet printer records an image on a recording medium by depositing ink on the recording medium from the nozzles while moving the inkjet head relative to the recording medium.

In this type of inkjet printer, ink is supplied from an ink tank to a pressure chamber through an ink supply passage. A piezoelectric element is then driven by applying to the piezoelectric element an electric signal corresponding to image data, whereby a diaphragm constituting a part of the pressure chamber is deformed such that the volume of the pressure chamber decreases. As a result, the ink in the pressure chamber is ejected from the nozzle in liquid droplet form.

In this type of inkjet printer, a single image is formed on the recording medium by combining dots formed by the ink ejected through the nozzles. In recent years, demands have been made of inkjet printers for high-quality image formation on a par with photographic prints. To realize such high image quality, it is possible to reduce the size of the ink droplets ejected through the nozzles by decreasing the nozzle diameter, and also to increase the number of pixels per unit area by arranging the nozzles at a higher density.

To increase the density of the nozzle array, the structure of electric wires for driving the nozzles and a method of connecting the electric wires to electrodes must be devised. Various proposals relating to these problems have been made.

For example, an apparatus is known in which a nozzle is disposed on a piezoelectric element side, a structure in which an aluminum plug passes through laminated layers is employed, and the head is formed by silicon photoetching. In so doing, an attempt is made to increase density and reduce costs (see Japanese Patent Application Publication No. 2000-289201, for example).

As another example, an apparatus is known in which a porous member made of sintered stainless steel or the like and having a large number of internally-connected small holes is used as an ink supply plate so that ink can pass through this part. In so doing, an attempt is made to realize an inkjet head having excellent refill, ink mixing, and filtration properties (see Japanese Patent Application Publication No. 2003-512211, for example).

In another example, an attempt is made to simplify the structure by connecting a drive wire to a packaging portion provided in an area on the opposite side to a piezoelectric element (see Japanese Patent Application Publication No. 2003-136721, for example).

However, in the apparatus described in Japanese Patent Application Publication No. 2000-289201, for example, a structure in which an aluminum plug passes through laminated layers is employed, but since the head is formed by silicon photoetching, it is difficult to form deep electrodes and increase the size of the head.

In the apparatus described in Japanese Patent Application Publication No. 2003-512211, bumps are formed on both sides of an insulation plate, and electrodes are extracted by applying pressure to the piezoelectric element using an elastic pad. With this constitution, however, it is difficult to achieve an increase in density, and the connections are likely to become unstable.

In the apparatus described in Japanese Patent Application Publication No. 2003-136721, it is difficult to form narrow, deep wires due to the disclosed wiring pattern, wire bonding connection, and method of extracting electrodes using thin plates.

SUMMARY OF THE INVENTION

The present invention has been contrived in consideration of these circumstances, and it is an object thereof to provide a liquid ejection head, a liquid ejection head manufacturing method, and an image forming apparatus in which a connection structure for a large number of electric wires can be formed efficiently, enabling improvements in productivity and precision, and increased connection stability.

In order to attain the aforementioned object, the present invention is directed to a liquid discharge head, comprising: a plurality of ejection ports which eject liquid; a plurality of pressure chambers which communicate respectively with the plurality of ejection ports; a plurality of piezoelectric elements which deform the plurality of pressure chambers respectively and are provided on a side of the pressure chambers opposite to a side on which the ejection ports are formed; a common liquid chamber which supplies the liquid to the plurality of pressure chambers and is formed on a side of the piezoelectric element opposite to the pressure chambers; and a plurality of electric wires which stand upright from and substantially perpendicular to a surface on which the piezoelectric elements are mounted, the electric wires passing through a partition wall of the common liquid chamber and being electrically connected to the piezoelectric elements, the electric wires being formed by inserting wiring material for forming the electric wires into holes provided in the partition wall of the common liquid chamber.

According to the present invention, a large number of columnar electric wires can be formed at once, and a connection structure for the large number of electric wires can be formed efficiently, enabling improvements in productivity and precision, and increased connection stability.

Preferably, the electric wires are formed by applying pressure to the wiring material stacked on a member forming the partition wall of the common liquid chamber, in order to insert the wiring material into the holes. Accordingly, fitting irregularities caused by errors in the diameter of the hole for forming the electric wire by inserting the wiring material therein are lessened, enabling an improvement in productivity.

Preferably, a connection portion of the piezoelectric element which is electrically connected to the electric wire takes a recessed form. Accordingly, the wiring material for forming the electric wires can be guided easily, leading to an improvement in the alignment precision of the electrode connection portion.

Preferably, a space is formed on a side of the connection portion opposite to the electric wire. Accordingly, the pressing pressure generated during pressure connection can be alleviated, elasticity can be maintained by the preload effect, and an increase in connection stability can be achieved.

In order to attain the aforementioned object, the present invention is also directed to a liquid discharge head, comprising: a plurality of ejection ports which eject liquid; a plurality of pressure chambers which communicate respectively with the plurality of ejection ports; a plurality of piezoelectric elements which deform the plurality of pressure chambers respectively and are provided on a side of the pressure chambers opposite to a side on which the ejection ports are formed; a common liquid chamber which supplies the liquid to the plurality of pressure chambers and is formed on a side of the piezoelectric element opposite to the pressure chambers; and a plurality of electric wires which stand upright from and substantially perpendicular to a surface on which the piezoelectric elements are mounted, the electric wires passing through a partition wall of the common liquid chamber and being electrically connected to the piezoelectric elements, the electric wires being formed of metal strings.

According to the present invention, a large number of columnar electric wires can be formed at once, and a connection structure for the large number of electric wires can be formed efficiently, enabling improvements in productivity and precision, and increased connection stability.

Preferably, the electric wires are formed by passing the metal strings through holes provided in a plurality of base plates stacked at a predetermined interval with a sacrificial layer inserted therebetween, cutting the metal strings in a predetermined position on a plane substantially parallel to the base plates, and removing the sacrificial layer. Accordingly, protrusions protruding from the plates to serve as columnar electric wires can be formed efficiently.

In order to attain the aforementioned object, the present invention is also directed to a manufacturing method for a liquid ejection head comprising: a plurality of ejection ports which eject liquid; a plurality of pressure chambers which communicate respectively with the plurality of ejection ports; a plurality of piezoelectric elements which deform the plurality of pressure chambers respectively and are provided on a side of the pressure chambers opposite to a side on which the ejection ports are formed; a common liquid chamber which supplies the liquid to the plurality of pressure chambers and is formed on a side of the piezoelectric element opposite to the pressure chambers, the method comprising the steps of: forming holes in a member which forms a partition wall of the common liquid chamber, the holes passing through the partition wall substantially perpendicularly to a surface on which the piezoelectric elements are mounted; then forming electric wires by stacking wiring material for forming the electric wires connected electrically to the piezoelectric elements onto the member for forming the partition wall of the common liquid chamber, and by applying pressure to the stacked wiring material to insert the wiring material into the holes formed in the partition wall of the common liquid chamber, and then joining a separately-formed lower layer part of the liquid ejection head which includes the pressure chambers having the piezoelectric elements and the ejection ports, to the member forming the partition wall of the common liquid chamber, into which the wiring material has been inserted.

According to the present invention, a large number of columnar electric wires can be formed at once, and a connection structure for the large number of electric wires can be formed efficiently, enabling improvements in productivity and precision, and increased connection stability.

Preferably, in the joining step, the inserted wiring material is subjected to further pressure control in order to electrically connect the wiring material to the piezoelectric elements. Accordingly, the wiring material can be pushed to an optimal depth when being pushed into the hole, and hence defective connection and member breakage can be prevented.

In order to attain the aforementioned object, the present invention is also directed to a manufacturing method for a liquid ejection head, comprising the steps of: stacking, at a predetermined interval, a plurality of base plates each formed with holes in predetermined positions, and passing metal strings through the holes; then forming a sacrificial layer between the base plates; then cutting each of the metal strings in a predetermined position of the sacrificial layer on a plane substantially parallel to the base plates; then removing the sacrificial layer through melting to form an upper layer portion of the liquid ejection head comprising the metal strings which serve as electric wires extending substantially perpendicular to the base plates; then applying a conductive agent to electrode connection portions of a separately-formed lower layer portion of the liquid ejection head which includes pressure chambers having piezoelectric elements and ejection ports, the electrode connection portions being for connection with tip end portions of the metal strings; and then joining the upper layer portion and the lower layer portion to form the metal strings into electric wires which stand upright from the electrode connection portions substantially perpendicularly to the piezoelectric elements and pass through a common liquid chamber formed on the pressure chambers.

According to the present invention, a large number of columnar electric wires can be formed at once, and a connection structure for the large number of electric wires can be formed efficiently, enabling improvements in productivity and precision, and increased connection stability.

Preferably, a sectional form of the metal strings is set such that a ratio between a long side and a short side thereof is no less than 1.1. Accordingly, the air bubble removal property of the liquid in the common liquid chamber can be enhanced.

In order to attain the aforementioned object, the present invention is also directed to an image forming apparatus, comprising the above-described liquid ejection head.

According to the liquid ejection head, the liquid ejection head manufacturing method, and the image forming apparatus of the present invention, as described above, a large number of columnar electric wires can be formed at once, and a connection structure for the large number of electric wires can be formed efficiently, enabling improvements in productivity and precision, and increased connection stability.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
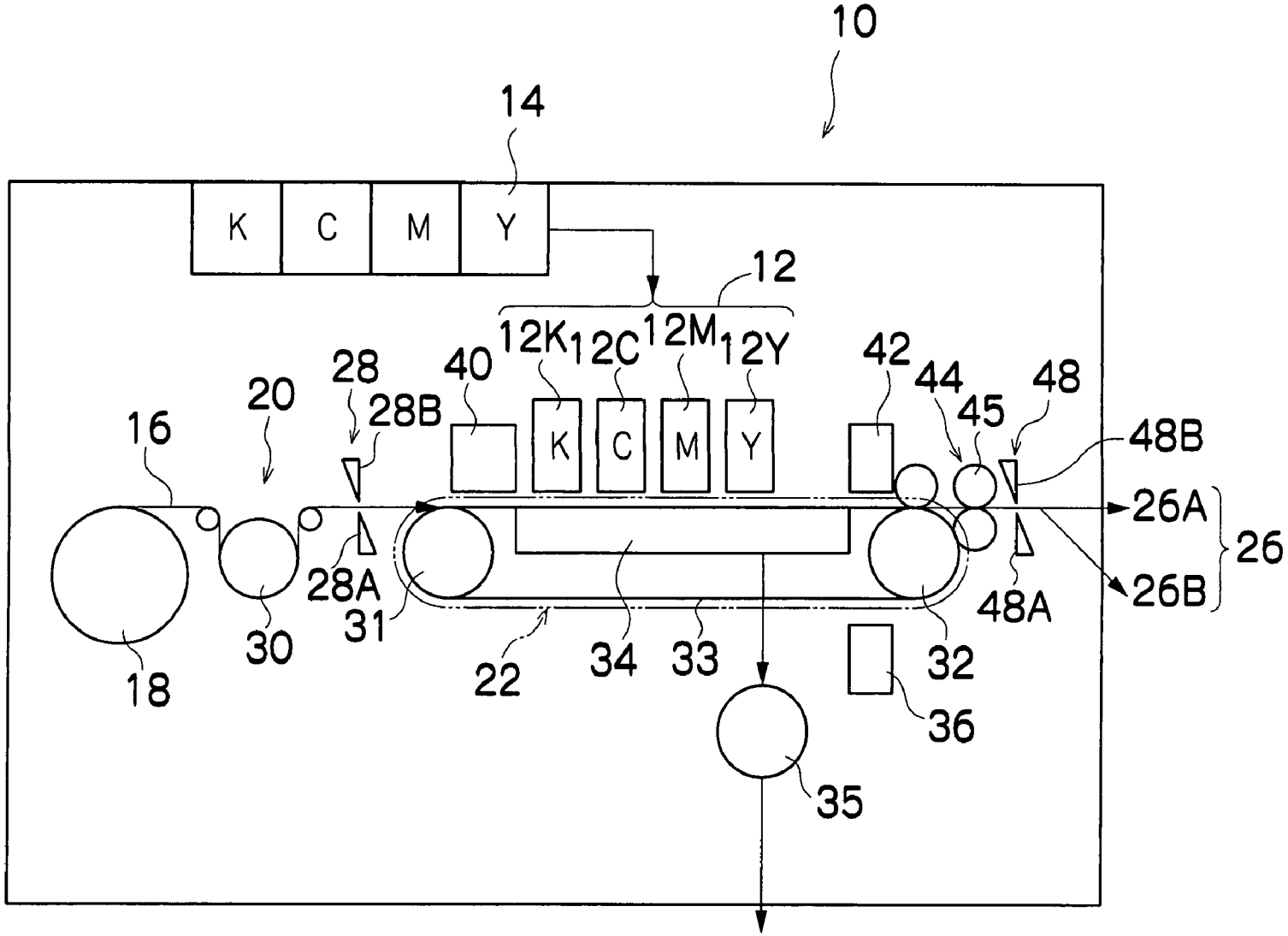
FIG. 1 is a general schematic drawing showing an outline of a first embodiment of an inkjet recording apparatus serving as an image forming apparatus comprising a liquid ejection head according to the present invention.

FIG. 1 is a general schematic drawing showing an outline of an embodiment of an inkjet recording apparatus serving as an image forming apparatus comprising a liquid ejection head according to the present invention.

As shown in FIG. 1, an inkjet recording apparatus 10 comprises a print unit 12 having a plurality of print heads (liquid ejection heads) 12K, 12C, 12M, 12Y provided for the respective ink colors, an ink storing and loading unit 14 in which the ink supplied to the print heads 12K, 12C, 12M, 12Y is stored, a paper supply unit 18 which supplies recording paper 16, a decurling unit 20 which removes curls from the recording paper 16, a suction belt conveyance unit 22 disposed opposite a nozzle face (ink ejection face) of the print unit 12 for conveying the recording paper 16 while maintaining the flatness of the recording paper 16, and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus constitution using rolled paper, as shown in FIG. 1, a cutter 28 is provided, and the rolled paper is cut into the desired size by this cutter 28. The cutter 28 is constituted by a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. Note that when cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a plane (flat plane).

The belt 33 has a width that is greater than the width of the recording paper 16, and a plurality of suction apertures (not shown) are formed on the belt surface. A suction chamber 34 is disposed in a position facing the nozzle face of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 forms a so-called full-line head (see FIG. 2) in which line heads having a length which corresponds to the maximum paper width are disposed in an orthogonal direction (main scanning direction) to the paper conveyance direction (sub-scanning direction).

Figure 2:
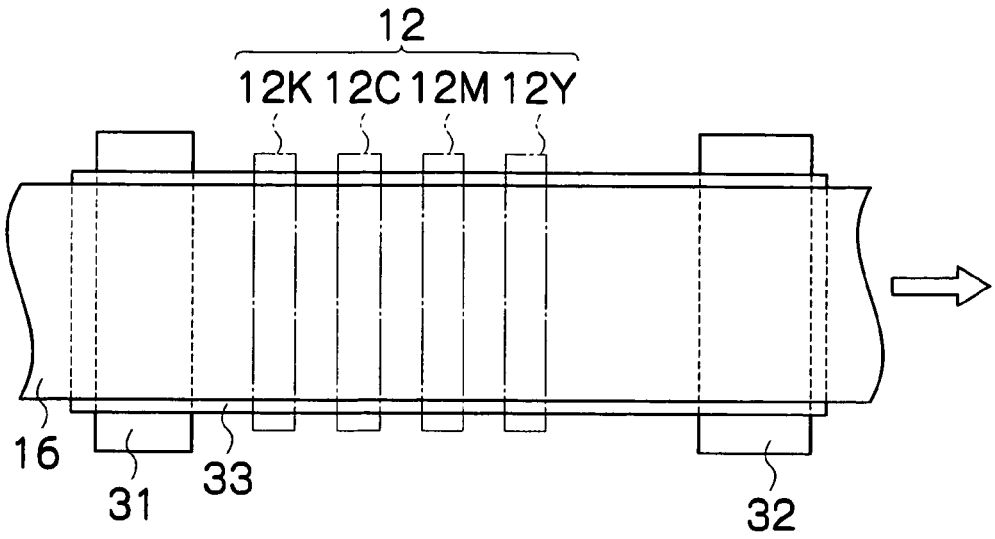
FIG. 2 is a principal plan view showing the periphery of a print unit in the inkjet recording apparatus shown in FIG. 1.

As shown in FIG. 2, each print head 12K, 12C, 12M, 12Y is constituted as a line head in which a plurality of ink ejection ports (nozzles) are arranged over a length which exceeds at least one side of the maximum sized recording paper 16 that can be used in the inkjet recording apparatus 10.

The print heads 12K, 12C, 12M, 12Y corresponding to the ink colors are disposed in order of black (K), cyan (C), magenta (M), and yellow (Y) from the upstream side (the left side in FIG. 1) in the conveyance direction (paper conveyance direction) of the recording paper 16. A color image can be formed on the recording paper 16 by depositing colored ink thereon from the respective print heads 12K, 12C, 12M, 12Y while conveying the recording paper 16.

According to the print unit 12, in which a full line head covering the entire paper width is provided for each ink color, an image can be recorded on the entire surface of the recording paper 16 by performing an operation to move the recording paper 16 relative to the print unit 12 in the paper conveyance direction (sub-scanning direction) a single time (i.e. with one sub-scan). In so doing, it is possible to achieve a higher print speed than that of a shuttle head, in which the print head performs a reciprocating movement in an orthogonal direction (the main scanning direction) to the paper conveyance direction. As a result, an improvement in productivity can be achieved.

Although the configuration with the KCMY four standard colors is described in the present embodiment, combinations of the ink colors and the number of colors are not limited to those. Light inks, dark inks can be added as required. For example, a configuration is possible in which print heads for ejecting light-colored inks such as light cyan and light magenta are added.

As shown in FIG. 1, the ink storing and loading unit 14 comprises tanks storing colored ink corresponding to the print heads 12K, 12C, 12M, 12Y. Each tank communicates with its print head 12K, 12C, 12M, 12Y via a pipe not shown in the drawing. The ink storing and loading unit 14 further comprises a notification device (a display device, warning sound generating device or the like) for providing notification of a low remaining ink amount, and a mechanism for preventing situations in which the wrong ink color is loaded.

A post-drying unit 42 is disposed following the print head 12K, 12C, 12M, 12Y The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
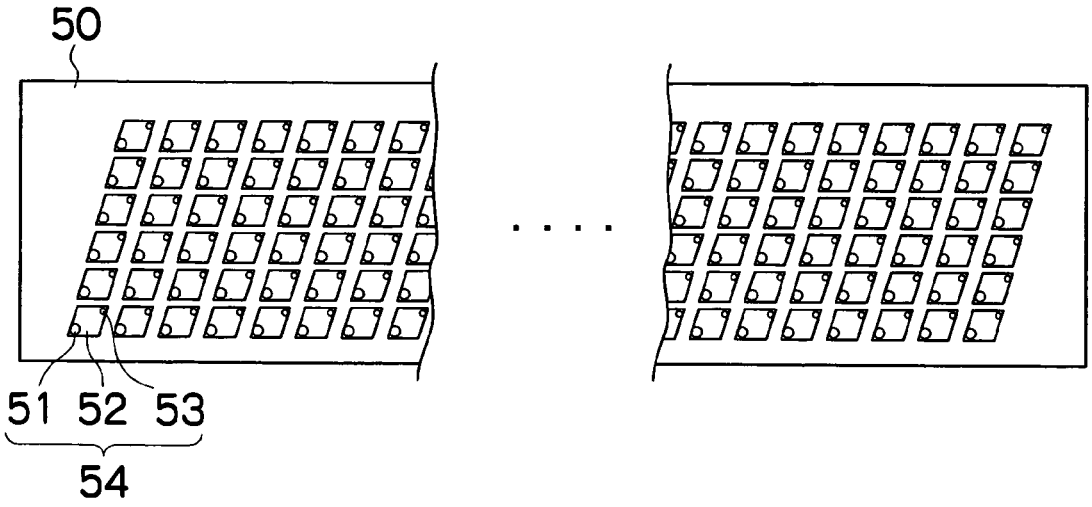
FIG. 3 is a projected plan view showing a structural example of a print head.

Next, the nozzle (liquid ejection port) arrangement in the print head (liquid ejection head) will be described. The print heads 12K, 12C, 12M, 12Y provided for the ink colors have a common structure, and hence in the following description, the print heads will be represented by the reference numeral 50. FIG. 3 shows a projected plan view of the print head 50.

As shown in FIG. 3, in the print head 50 of this embodiment, pressure chamber units 54 constituted by a nozzle 51 which ejects ink in the form of liquid droplets, a pressure chamber 52 which applies pressure to the ink during ink ejection, and an ink supply port 53 which supplies ink to the pressure chamber 52 through a common flow passage, not shown in FIG. 3, are arranged in a two-dimensional, staggered matrix form so that the nozzles 51 are provided at a high density.

In the example shown in FIG. 3, each pressure chamber 52 takes a substantially parallelogram planar form when seen from above, although the planar form of the pressure chamber 52 is not limited to a parallelogram shape. As shown in FIG. 3, the nozzle 51 is formed at one end of the diagonal of the pressure chamber 52, and the ink supply port 53 is provided at the other end.

Figure 4:
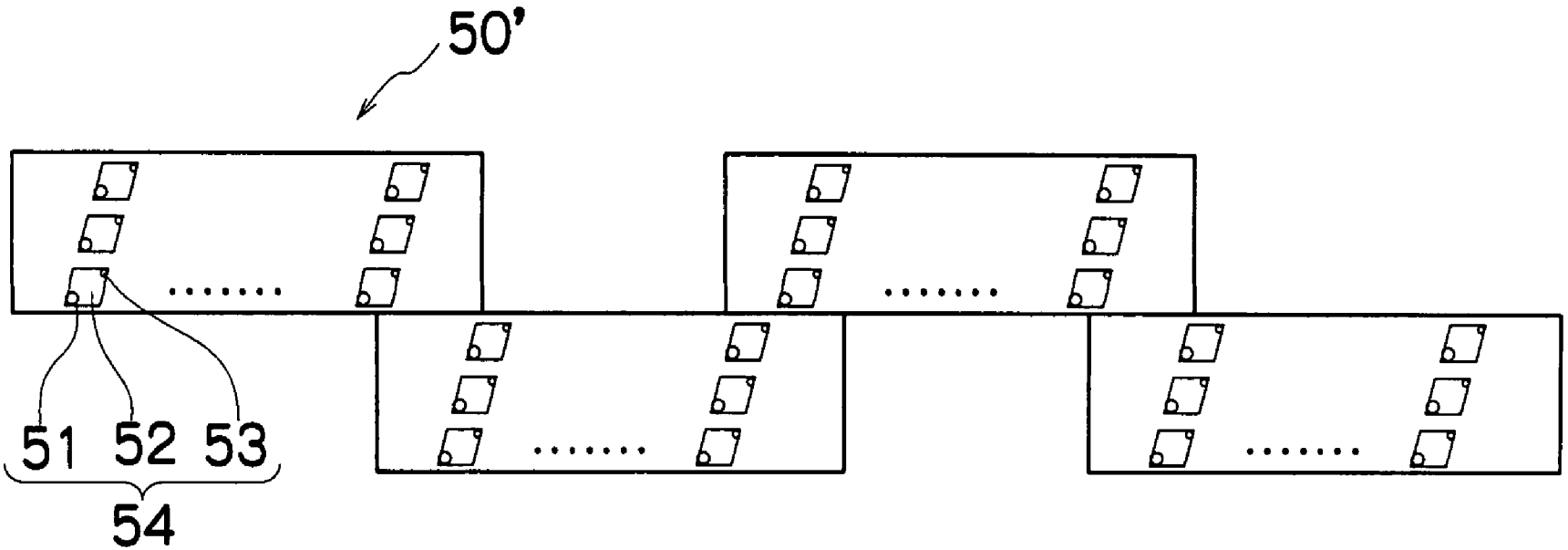
FIG. 4 is a plan view showing another example of a print head.

FIG. 4 is a projected plan view showing a structural example of another print head. As shown in FIG. 4, a plurality of short heads 50' may be arranged two-dimensionally in zigzag form and connected such that the plurality of short heads 50' form a single, elongated full-line head having an overall length which corresponds to the entire width of the print medium.

Figure 5:
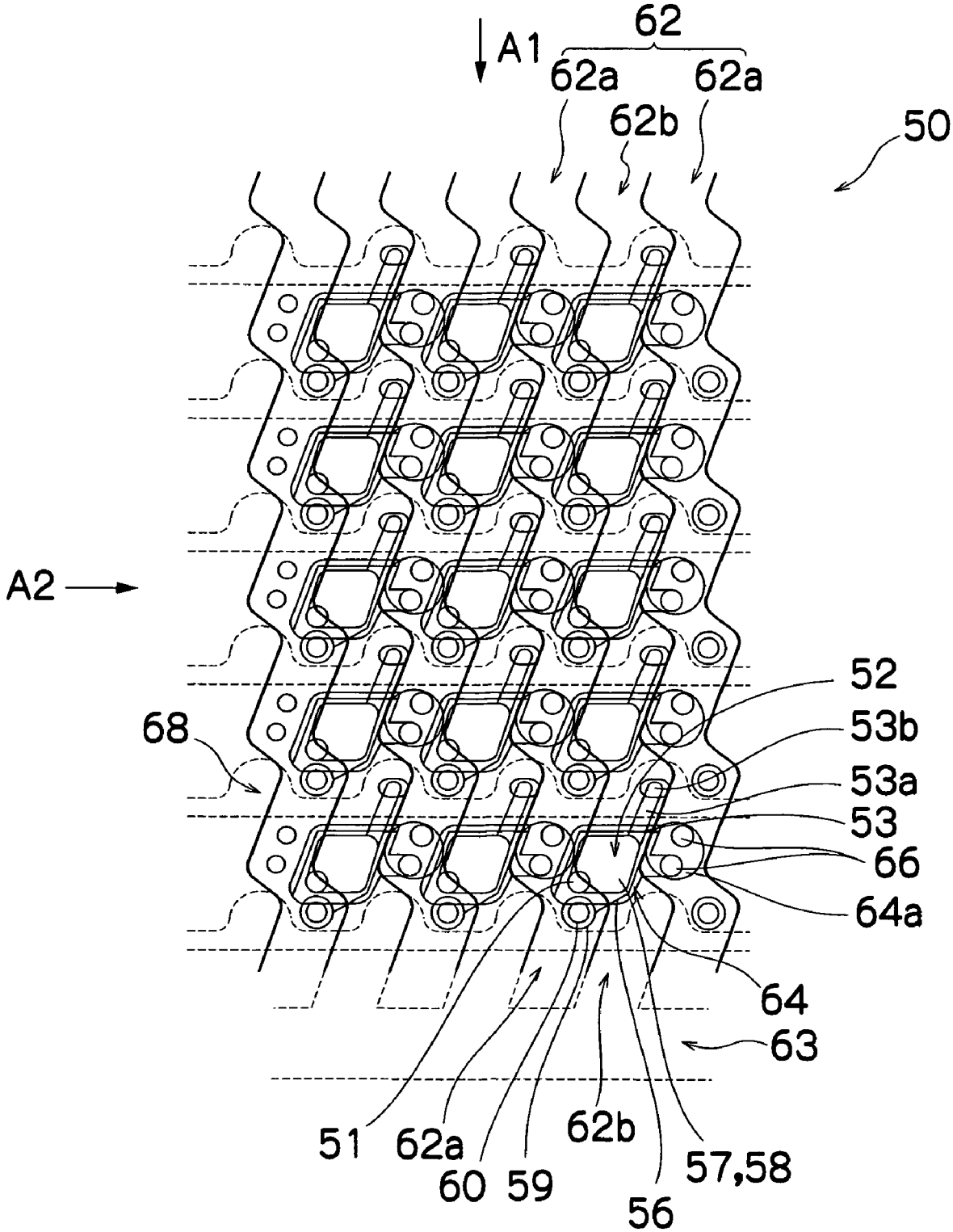
FIG. 5 is a projected perspective view showing an enlargement of a part of the print head in an embodiment of the present invention.

FIG. 5 is a partially enlarged, projected plan view of the print head 50 according to this embodiment.

As will be described in detail below, the print head 50 of this embodiment is formed by laminating a large number of various types of plate members.

As described above, the parallelogram-shaped pressure chambers 52 comprising the nozzle 51 and supply port 53 are arranged in the print head 50 in a two-dimensional, staggered matrix form. A surface (ceiling face) of the pressure chamber 52 opposing the surface (bottom face) formed with the nozzle 51 is constituted by a diaphragm 56 which doubles as a common electrode. A piezoelectric body (piezo) 58 is formed on the diaphragm 56 in a form which corresponds to the form of the pressure chamber 52, and an individual electrode 57 is formed on the piezoelectric body 58.

A wire is drawn out from the individual electrode 57 to the outside of the pressure chamber 52 from the side end portion of the nozzle 51, and forms an electrode pad 59 which serves as an electrode connection portion. A columnar electric wire (electric column) 60 is formed substantially perpendicular to (the attachment surface of) the piezoelectric body 58 so as to stand upright from the electrode pad 59.

To form the columnar electric wire 60, flow passage plates 62, constituted by a plurality of narrow, strip-form beam portions 62*a* extending in wave form in the vertical direction of the drawing and connected at both ends (although the ends are not shown in the drawing), are laminated together. The spaces between the beam portions 62*a* that are formed by laminating together the flow passage plates 62 form tributaries 62*b* which serve as a common liquid chamber, or in other words a common ink supply flow passage for supplying each pressure chamber 52 with ink. By laminating together the beam portions 62*a*, partition walls are formed between the tributaries 62*b* serving as the common liquid chamber, and the columnar electric wires (electric columns) 60 are formed so as to pass through these partition walls.

Further, an ink flow passage 53*a* extends from the ink supply port 53 formed in one corner of the pressure chamber 52, and a supply restrictor 53*b* which receives the supply of ink from the sub flow 62*b* is formed at the tip end of the ink flow passage 53*a*. Although shown only in the lower section of the drawing by a broken line, the two ends of the sub flow 62*b* (at the top and bottom of the drawing) are connected to a main flow 63 of the ink supply flow passage, extending in the left/right direction of the drawing. Ink is supplied into the main flow 63 of the ink supply flow passage from an ink tank, not shown in the drawing, and then supplied from the main flow 63 to each sub flow 62*b*. From the sub flow 62*b*, the ink is supplied through the ink supply port 53 to the pressure chamber 52 via the supply restrictor 53*b* provided for each pressure chamber 52.

A sensor plate 64 for determining the ink ejection state by measuring the internal pressure of the pressure chamber 52 is disposed on the lower side of the pressure chamber 52, and an electrode pad 64*a* is formed on the part of the sensor plate 64 on the outside of the pressure chamber 52. An electric wire (sensor column) 66 for extracting measurement signals from the sensor plate 64 is provided in an upright manner substantially perpendicular to the sensor plate 64, similarly to the electric column 60 described above.

The structure of these laminated layers forming the print head 50 will be described in detail below. Note, however, that a piezo cover 68 is disposed on the piezoelectric body 58 to cover the piezoelectric body 58 and thereby protect the piezoelectric body 58 from ink, to stabilize driving of the piezoelectric body 58 in isolation from the ink, and to provide a damping characteristic so that crosstalk is reduced.

Next, the structure of the laminated layers of the print head 50 will be described using FIGS. 6 and 7.

Figure 6:
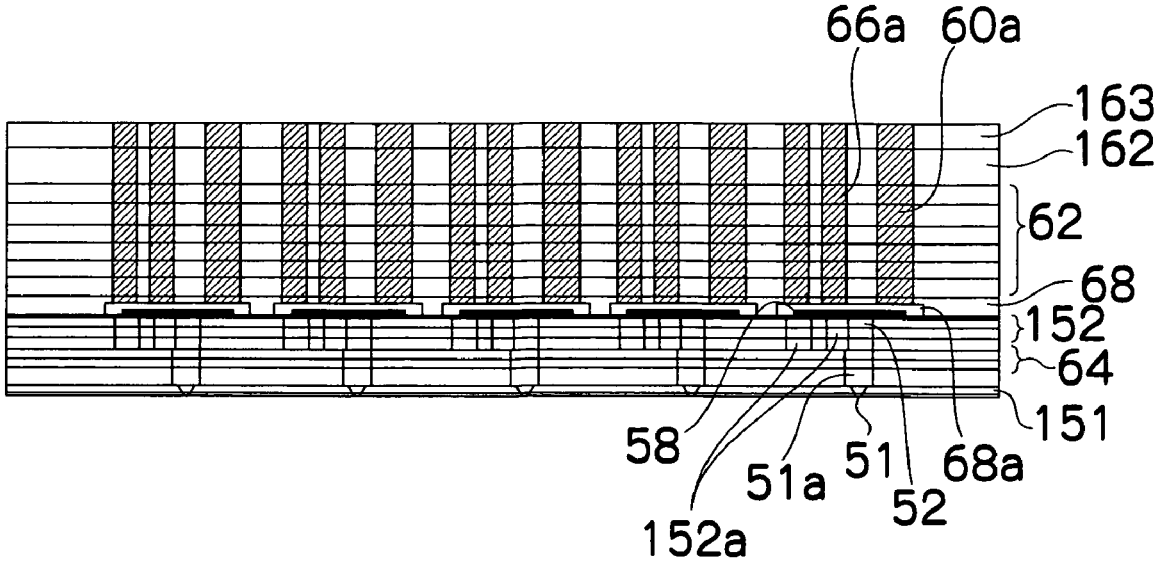
FIG. 6 is a projected side view of the print head shown in FIG. 5, seen from the direction of an arrow A1.
Figure 7:
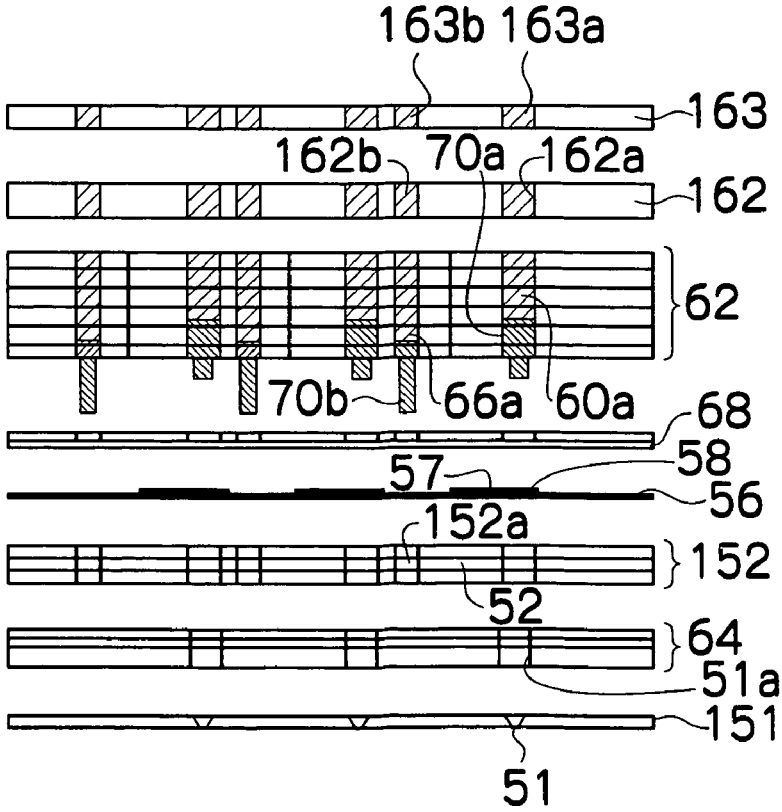
FIG. 7 is a projected, exploded side view of the print head shown in FIG. 5, seen from the direction of an arrow A2.

FIG. 6 is a projected side view of FIG. 5 seen from the direction of an arrow A1 in FIG. 5, and FIG. 7 is an exploded, projected side view of FIG. 5 seen from the direction of an arrow A2 in FIG. 5.

Referring to FIGS. 6 and 7, first, a nozzle plate 151 in which the nozzles 51 are formed is disposed on the lowest layer of the print head 50. The nozzle plate 151 is formed by half-cut pressing and polishing a stainless steel thin plate, through nickel electroforming, or by implementing liquid repellency processing on a substance such as a polyimide that has been subjected to abrasion using an excimer laser, for example. The nozzle 51 is formed in a reverse tapered form such that its diameter decreases steadily toward the ink ejection side (outside).

Next, the sensor plate 64 for measuring the pressure inside the pressure chamber 52 is laminated onto the nozzle plate 151. A nozzle flow passage 51*a* connecting the pressure chamber 52 and nozzle 51 is formed in the sensor plate 64. The sensor plate 64 is formed by laminating polyvinylidene fluoride (PVDF) onto stainless steel, for example. The electrode pad 64*a* (see FIG. 5) serving as a connection portion for forming a connection to the sensor column 66, or in other words the electric wire for extracting measurement signals, is formed to correspond to the front and rear of the PVDF of the sensor plate 64, respectively.

A pressure chamber plate 152 which forms the pressure chamber 52 is laminated onto the sensor plate 64. The pressure chamber plate 152 is formed by subjecting stainless steel plates to multi-step etching or double-sided etching, and then laminating together these plates, for example. The pressure chamber plate 152 is formed with an opening serving as the pressure chamber 52 and supply restrictor 53*b*, and a through hole 152*a* for the sensor column 66. An adhesive escape groove (not shown in the drawing) or the like for allowing adhesive to escape so that excess adhesive does not run out during adhesion and block the pressure chamber 52 or supply restrictor 53*b* is formed as needed.

Next, the diaphragm 56 is laminated onto the pressure chamber plate 152 by epoxy adhesion or the like. The piezoelectric body 58 is then formed on the diaphragm 56 in a position corresponding to the pressure chamber 52. The piezoelectric body 58 employs a fired and polished plate formed with a common electrode by sputtering, and then subjected to mechanical separation. Further, although not shown in the drawing, a hole for the supply restrictor 53*b* and a hole for the sensor column 66 are formed in the diaphragm 56. The individual electrode 57 is formed on the piezoelectric body 58, and the electrode pad 59 (see FIG. 5) is drawn out from the individual electrode 57 onto an insulation layer.

Next, the piezo cover 68 is laminated onto the diaphragm 56 formed with the piezoelectric body 58. For example, the piezo cover 68 has a half-cut structure produced by subjecting a stainless steel thin plate to wet etching, and subjecting a part 68*a* corresponding to the position of the piezoelectric body 58 to half-etching in order to avoid the piezoelectric body 58 following lamination. Further, a hole for the supply port 53, and holes for the electric column 60 and sensor column 66 are formed in the piezo cover 68 (these holes are not shown in the drawing).

As described above, the part 68*a* of the piezo cover 68 corresponding to the position of the piezoelectric body 58 is subjected to half-etching in order to cover the piezoelectric body 58 and thereby protect the piezoelectric body 58 from ink, to stabilize driving of the piezoelectric body 58 in isolation from the ink, and to provide a damping characteristic so that crosstalk is reduced.

The flow passage plate 62, which is formed with cavity portions for the electric column 60 and sensor column 66, i.e. the columnar electric wires, and which forms the spaces for the tributaries 62*b* of the ink supply flow passage, is laminated onto the piezo cover 68. The flow passage plate 62 is formed by subjecting a stainless steel thin plate to wet etching, for example. As shown in FIG. 5, the flow passage plate 62 is formed into a single plate (not shown in the drawing) by arranging a large number of elongated wave-form beam portions 62*a* in series and connecting the beam portions 62*a* at both ends. The spaces between the beam portions 62*a* become the tributaries 62*b* (common liquid chamber). Hence the common liquid chamber is formed on the opposite side of the pressure chamber 52 to the nozzle 51.

The flow passage plate 62 is also formed with a hole 60*a* for the electric column 60 and a hole 66*a* for the sensor column 66 in each beam portion 62*a*. As shown in FIG. 7 in particular, a plate material 70*a* which will serve as the electric column 60 is inserted into the hole 60*a*, and a plate material 70*b* which will serve as the sensor column 66 is inserted into the hole 66*a*. This will be described in detail below.

A plate 162 for sealing the main flow 63 and tributaries 62*b* is laminated onto the flow passage plate 62, and another plate 163 for sealing the main flow 63 is laminated onto the plate 162. The plate 163 for sealing the main flow 63 may double as a heater for controlling the overall temperature of the laminated plates. Further, as shown in FIG. 7, the plates 162 and 163 are formed respectively with holes 162*a* and 163*a* for the electric column 60, and holes 162*b* and 163*b* for the sensor column 66.

The print head 50 has the laminated structure described above. As will be described below, a power board constituted by a multi-layer flexible cable having bumps and packaged with a driver IC and the like is joined to the top of the print head 50.

Next, a manufacturing method for the print head 50 will be described following the flowchart in FIG. 8 and with reference to FIGS. 9 and 10.

Figure 8:
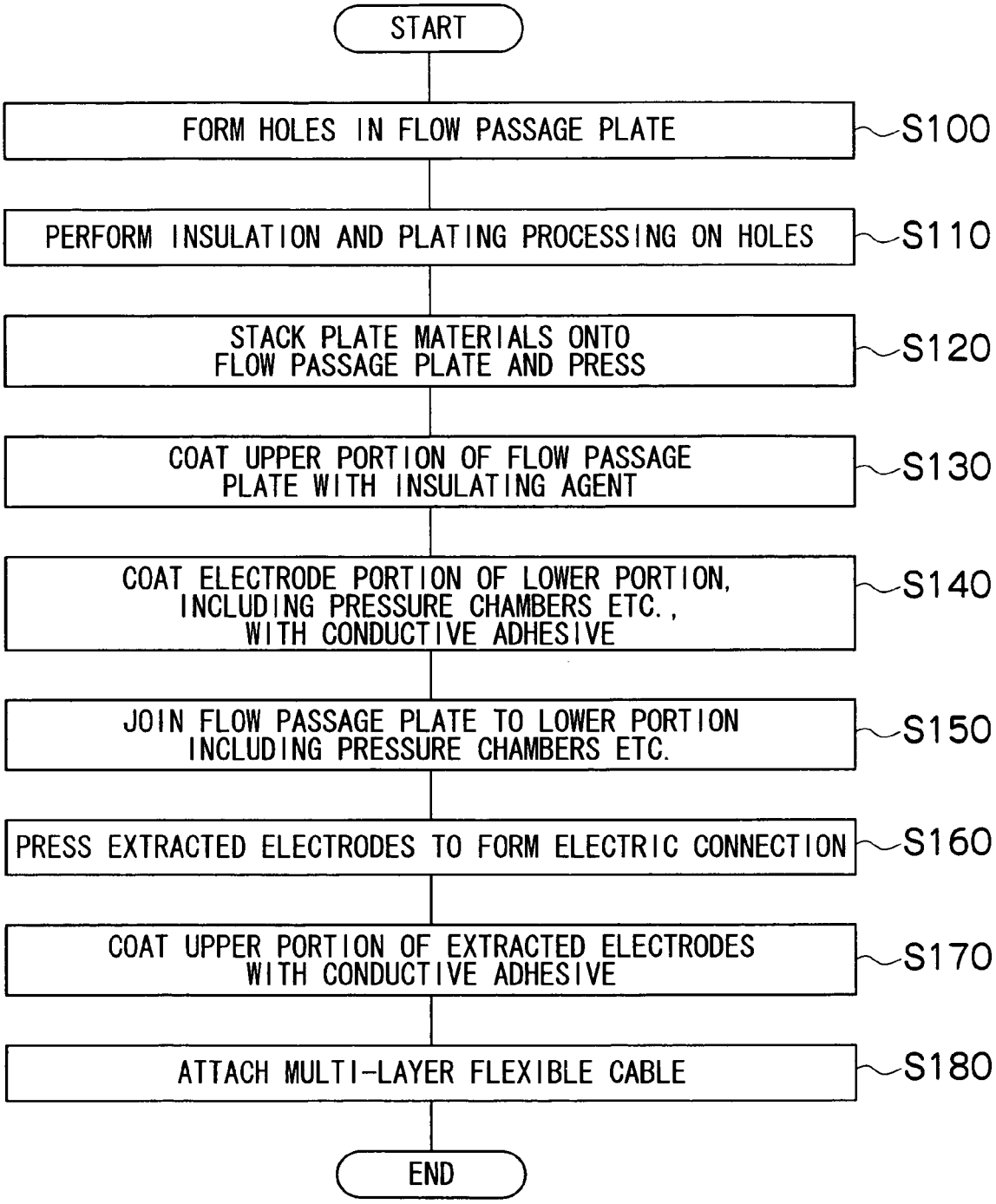
FIG. 8 is a flowchart showing a print head manufacturing process of this embodiment.

FIG. 8 is a flowchart illustrating in sequence a manufacturing method for the print head 50 in this embodiment.

First, in a step S100 in FIG. 8, through holes 160 (60*a*, 162*a*, 163*a*) for the electric column 60, and through holes 166 (66*a*, 162*b*, 163*b*) for the sensor column 66 are opened in the flow passage plate 62 and the plates 162, 163 for sealing the tributaries and main flow, respectively (see also FIG. 7). There are no particular limitations on the method of opening the holes. For example, the holes may be cut out of a thick stainless steel plate by pressing, or thin plates may be etched and then laminated together.

Next, in a step S110, insulation processing is performed on all of the laminated plates 62, 162, 163, whereupon electroless plating is implemented on the inside of the through holes 160, 166.

Figure 9:
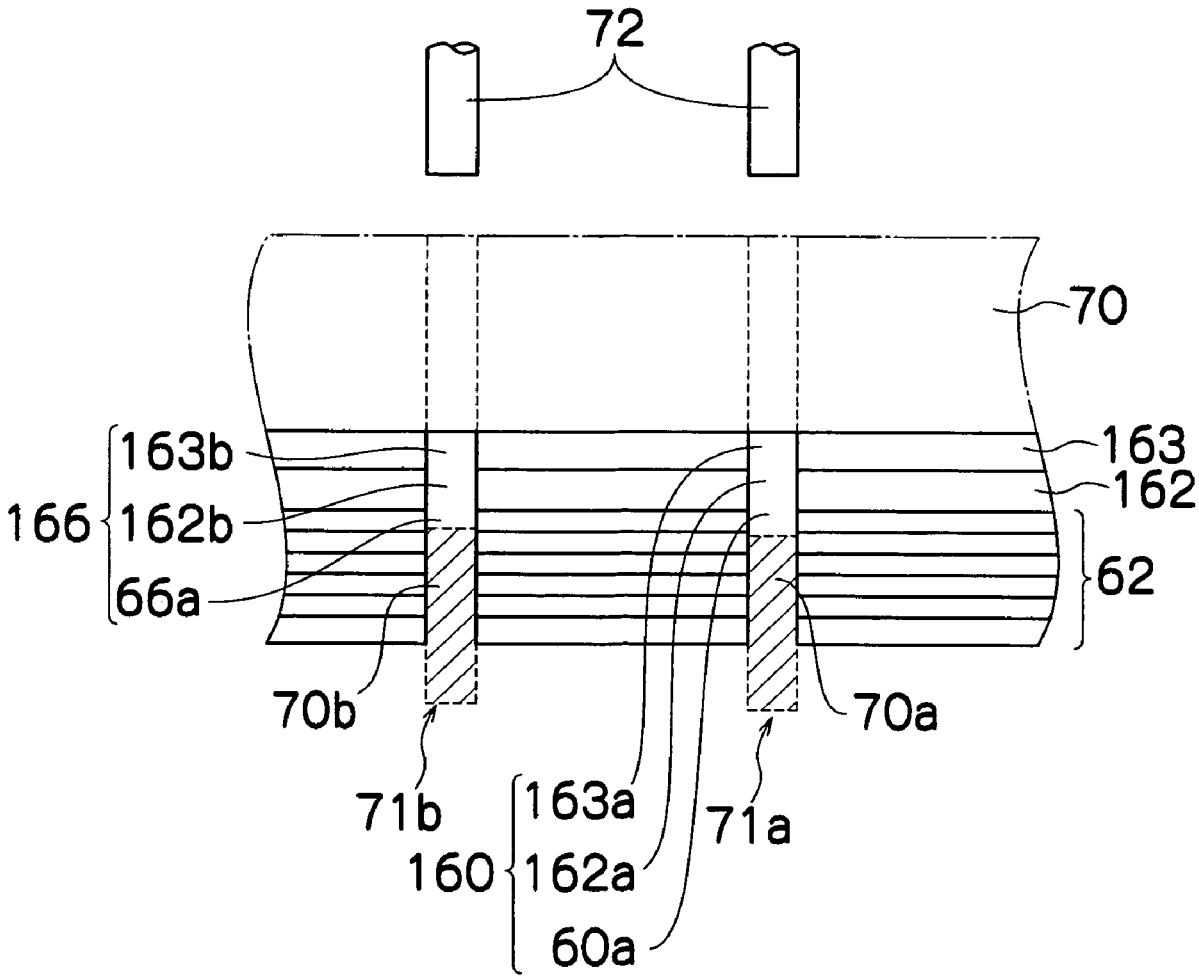
FIG. 9 is an illustrative view showing the pressing of a plate material to form an extracted electrode.

Next, in a step S120, a plate material 70 which will serve as an electrode is stacked on top of the laminated plates 62, 162, 163 as shown in FIG. 9, and pressed using the laminated plates 62, 162, 163 as a die. A copper or aluminum thin plate may be used as the plate material 70, for example.

On top of the plates 62, 162, 163 formed by laminating together copper thin plates, the plate material 70 is pushed down from above using punches 72 to form punched out plate materials 70*a*, 70*b*, and the punched out plate materials 70*a*, 70*b* are filled into the interior of the through holes 160, 166 of the laminated plates 62, 162, 163 to serve as extracted electrodes.

At this time, as shown by the broken lines in FIG. 9, the punched out plate materials 70*a*, 70*b* are pushed through to the lower side of the laminated plates 62, 162, 163 so as to protrude therefrom as protruding portions 71*a*, 71*b* which serve as the extracted electrodes.

Figure 11:
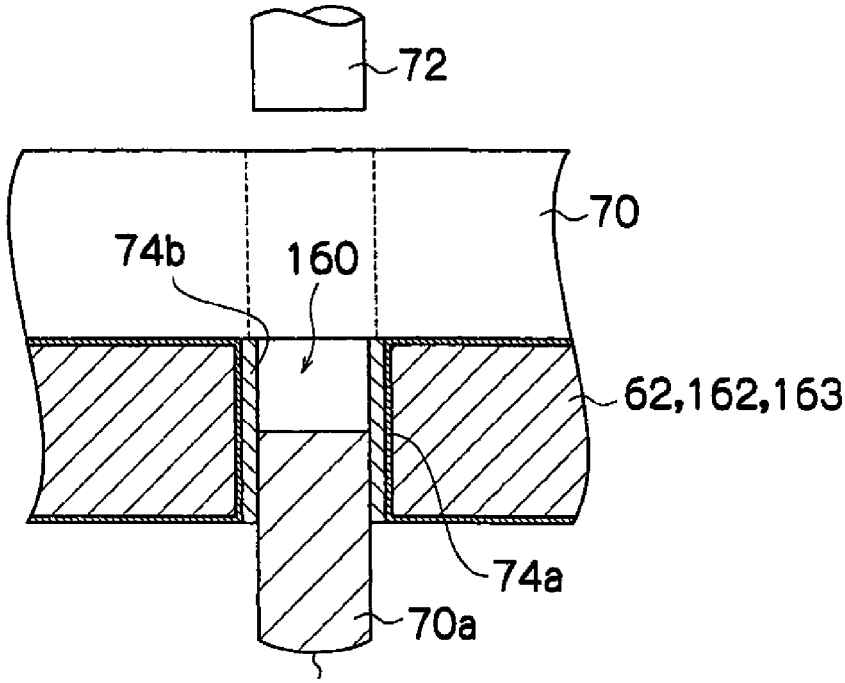
FIG. 11 is an illustrative view showing an enlargement of plate material pressing.

FIG. 11 shows an enlargement of this pressing operation. As shown in FIG. 11, an insulation layer 74*a* is formed on the surface of the flow passage plate 62 and the plates 162, 163, and plating 74*b* is implemented on the part of the through hole 160. The plate material 70 is then placed on top and punched through using the punches 72 so that the part of the plate material 70*a* corresponding to the through hole 160 is pushed into the through hole 160. As a result, the protruding portion 71*a*, which serves as a rod-form extracted electrode, is pushed out from the lower side.

Next, in a step S130, the upper portion of the laminated plates 62, 162, 163 is coated with an insulating agent as needed. This is performed to compensate for any damage that may have occurred to the upper side insulating film during the pressing operation.

To reduce the damage caused by the pressing operation, the through holes 160, 166 may be formed in an inverse-tapered form such that their diameter is not constant, but instead widens toward the lower side.

Next, in a step S140, the electrode portion of the separately-formed lower portion structure of the print head 50, constituted by the pressure chamber 52 and so on, is coated with a conductive adhesive to enable the protruding portions 71*a*, 71*b* of the extracted electrodes formed above to be connected thereto. The conductive adhesive is applied using a dispenser or an inkjet head. When an identical inkjet head to the inkjet head 50 being manufactured is used, the pitch of the electric wire formation positions and so on match, which is preferable.

Next, in a step S150, the laminated plates 62, 162, 163 are joined to the lower portion structure of the print head 50 constituted by the pressure chamber 52 and so on.

Figure 10:
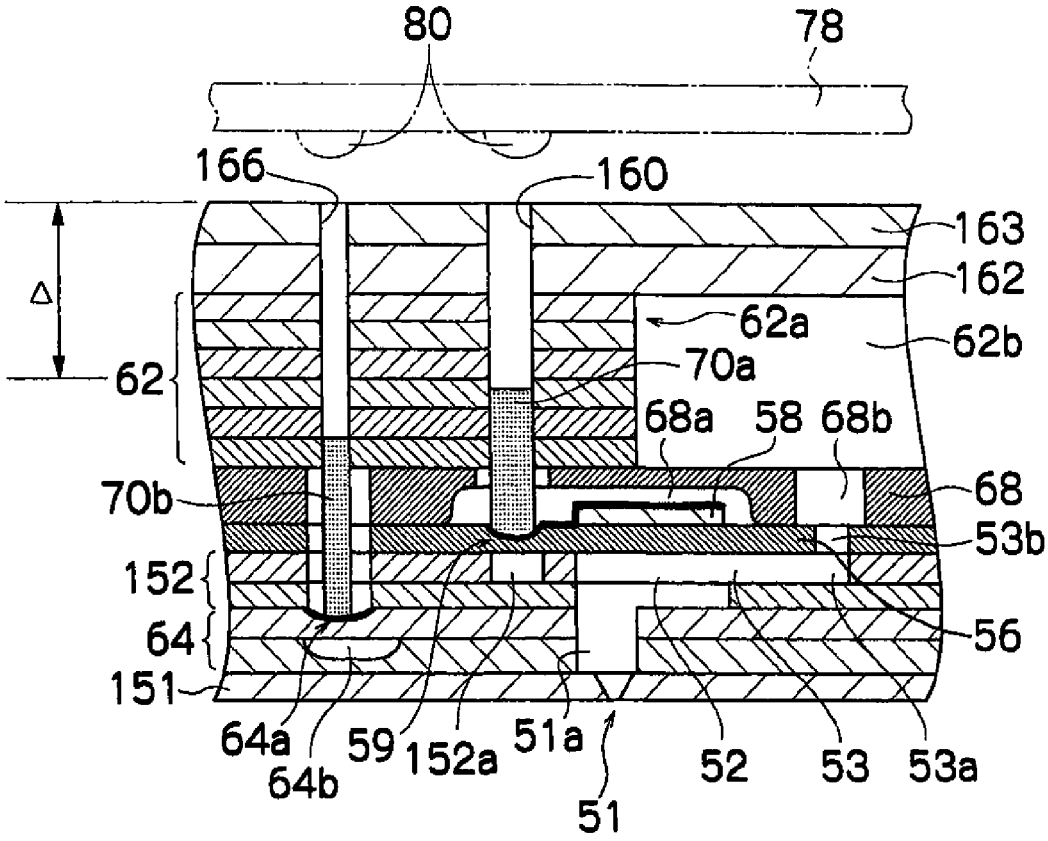
FIG. 10 is a sectional view showing connection of the extracted electrode.

As shown in FIG. 10, the plate material 70*a* that is punched out to form the electric column 60 is adhered to the electrode pad 59 drawn out from the individual electrode 57 on the piezoelectric body 58, and the plate material 70*b* that is punched out to form the sensor column 66 is adhered to the electrode pad 64*a* formed on the sensor plate 64.

Next, in a step S160, the plate materials 70*a*, 70*b* are pressed down further to secure the electrode connection, and thus the extracted electrode protruding portions 71*a*, 71*b* are connected to the electrode pads 59, 64*a* respectively. At this time, the part of the electrode pad 59 to which the plate material 70*a* is adhered and the part of the electrode pad 64*a* to which the plate material 70*b* is adhered take a rounded shape (bowl shape) with a recessed center, as shown in FIG. 10, and therefore self-alignment is possible, positioning and guiding can be performed easily, and adhesion can be performed securely and with good precision.

Moreover, at this time the pressure chamber plate 152 on the lower side of the electrode pad 59, which is adhered to the plate material 70*a* serving as the electric column 60, is formed with an opening 152*a* (relief portion). Similarly, a relief portion 64*b* is formed by half-etching in the sensor plate 64 on the lower side of the electrode pad 64*a* to which the plate material 70*b* serving as the sensor column 66 is adhered.

By forming relief structures on the respective opposing surfaces of the extracted electrodes (electric column 60 and sensor column 66) serving as columnar electric wires, the pressing pressure generated when the punched out pressed materials 70*a*, 70*b* are pushed even further can be alleviated while guiding the pressed materials 70*a*, 70*b* into the centrally-recessed, rounded form of the electrode pads 59, 64*a*, and hence elasticity can be maintained by applying a preload to the extracted electrodes.

When the plate materials 70*a*, 70*b* are pushed, as shown by Δ in FIG. 10, by providing the electrode pads 59, 64*a* in a state that is recessed further than the upper surface, the thickness of the plate material 70 can be reduced, and hence the force generated during punching and pressing can be reduced. This facilitates connection of a multi-layer flexible cable at a later stage, and hence a slightly pushed state is preferable.

Next, in a step S170, the upper portion of the extracted electrodes (the pushed-in plate materials 70*a*, 70*b*) is coated with a conductive adhesive or the like as needed to prevent loosening of the pushed-in plate materials 70*a*, 70*b* and to stabilize the connection.

Figure 12:
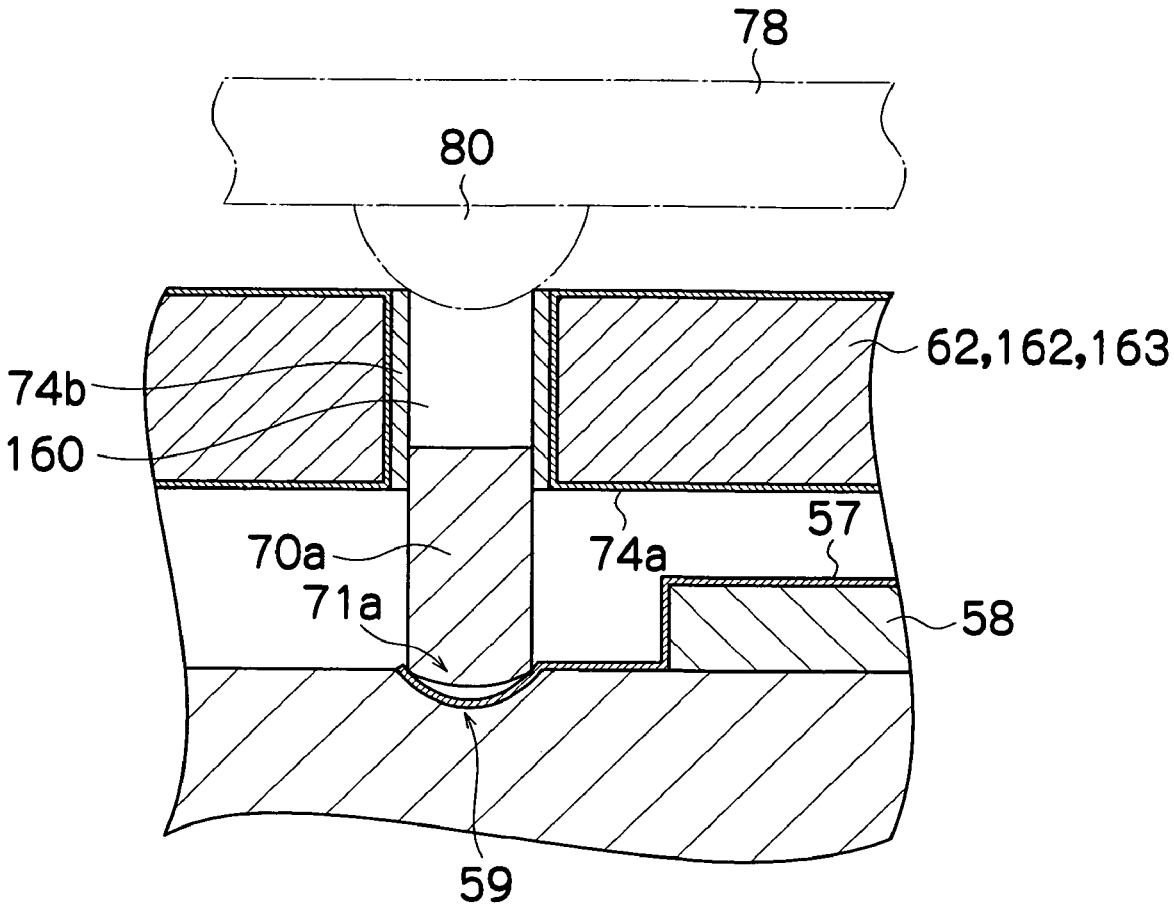
FIG. 12 is an enlarged illustrative view showing connection state of the extracted electrode.

Finally, in a step S180, a multi-layer flexible cable 78 formed with bumps 80 is attached. FIG. 12 shows an enlargement of a state in which the bump 80 on the multi-layer flexible cable 78 is connected to the through hole 160 corresponding to the electric column 60. At this time, the bump 80 is connected to the plating 74*b* part of the through hole 160 by a heat press, thereby becoming conductive, and at the same time, the protruding portion 71*a* serving as an extracted electrode is pressed from above again, thereby securing its connection to the electrode pad 59.

Hence according to this embodiment, plate materials serving as extracted electrodes are pressed using the flow passage plate as a die. In so doing, fitting irregularities caused by errors in the hole diameter are lessened, and a large number of columnar electric wires can be formed at once, enabling an improvement in productivity.

Further, by forming the connection portion in a recessed form (bowl form), and providing an opening or half-etched relief on the opposing surface of the connection portion, the alignment precision of the extracted electrode connection portion can be improved, and the connection can be further stabilized by the preload effect.

Furthermore, the plate material serving as the extracted electrode is pushed while monitoring the electrostatic capacity of the piezoelectric body and PVDF, and as a result, the plate material can be pushed to an optimum depth. Hence, defective contact and breakage of the members can be prevented.

Further, when the recessed portion of the extracted electrode connection portion is subjected to stainless steel wet-etching, for example, the bowl-shaped guides for the plate materials serving as the extracted electrodes can be formed easily, and hence the electrode members can be held with stability.

Note that in the manufacturing process described above, an example has been cited in which the pressing operation is divided into two processes, namely punching and pushing, but by performing the pressing operation in time-divided blocks, the force applied to the print head is reduced, and punching and pushing can be performed as a single process. Also in this embodiment, the flow passage plate 62 is formed by laminating together thin stainless steel plates, but resin plates may be used for a part of the flow passage plate 62. In this case, insulation processing is not required, and conductive patterns can be formed using a technique such as nano-imprinting, enabling an electric connection with the plate materials 70*a*, 70*b*, and simplification of the multi-layer flexible cable 78.

Next, a second embodiment of the present invention will be described.

Figure 13:
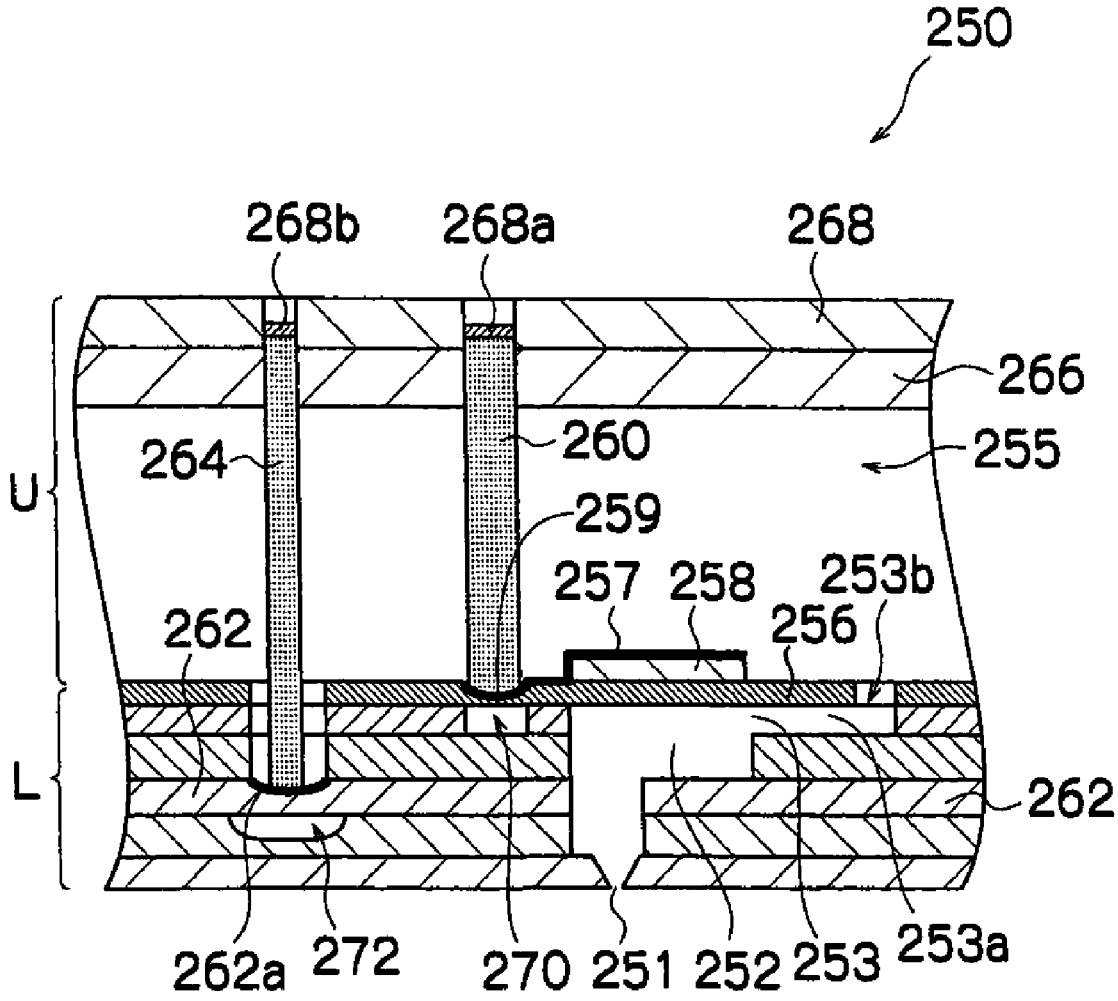
FIG. 13 is an enlarged sectional view showing a part of a print head according to a second embodiment of the present invention.

FIG. 13 is an enlarged sectional view showing a part of a print head 250 according to the second embodiment.

As shown in FIG. 13, in the print head 250 of this embodiment, the upper surface of a pressure chamber 252 which communicates with a nozzle 251 is constituted by a diaphragm 256, and a piezoelectric element 258 is formed on the upper side of the diaphragm 256. An individual electrode 257 which drives the piezoelectric element 258 is formed on the upper surface of the piezoelectric element 258, and a common liquid chamber 255 which supplies ink to the pressure chamber 252 is formed on the upper side of the diaphragm 256.

An ink supply port 253 is formed in the corner portion of the pressure chamber 252 on the opposite side to the side which communicates with the nozzle 251, and an ink supply passage 253*a* extends horizontally from the ink supply port 253. The ink supply passage 253*a* then passes through an opening formed in the diaphragm 256 to communicate with the common liquid chamber 255, and a supply restrictor 253*b* for restricting ink backflow is formed in the opening portion.

An electric wire (electric column) 260 for supplying a drive signal to the individual electrode 257 which drives the piezoelectric element 258 is formed from an electrode pad 259, which is drawn out from the individual electrode 257 to the side of the pressure chamber 252. The electric wire 260 stands upright substantially perpendicular to the surface comprising the piezoelectric element 258, and passes through the common liquid chamber 255.

A sensor plate 262 which functions as a pressure sensor for measuring the internal pressure of the pressure chamber 252 is disposed so as to form the bottom surface of the pressure chamber 252. The sensor plate 262 is formed by laminating PVDF onto stainless steel, for example. An electric wire (sensor column) 264 for extracting a pressure measurement signal from the sensor plate 262 is formed to stand upright substantially perpendicular to the sensor plate 262 from an electrode pad 262*a* provided on the sensor plate 262, and to pass through the common liquid chamber 255 similarly to the electric column 260. The electric wire (sensor column) 264 is formed to correspond to the front and rear of the PVDF, respectively.

A base plate 266 and a multi-layer flexible cable 268 are disposed on the common liquid chamber 255, and the electric column 260 and sensor column 264 are connected to the multi-layer flexible cable 268 by electrode pads 268*a* and 268*b*, respectively.

The electrode pad 259 on the side of the electric column 260 which connects to the piezoelectric element 258 and the electrode pad 262*a* on the side of the sensor column 264 which connects to the sensor plate 262 take a rounded form (bowl form) with a recessed center, as shown in FIG. 13. As a result, when the electric column 260 and sensor column 264 are connected to the electrode pads 259, 262*a* respectively, as will be described below, self-alignment is possible, positioning and guiding can be performed easily, and adhesion can be performed securely and with good precision.

Further, an opening 270 (relief portion) is formed on the lower side of the electrode pad 259 to which the electric column 260 is connected, and a relief portion 272 is formed by half-etching on the lower side of the electrode pad 262*a* to which the sensor column 264 is adhered. By forming these relief structures on the respective opposing surfaces of the columnar electric wires (electric column 260, sensor column 264), the joining pressure generated when the electric column 260 and sensor column 264 are connected can be alleviated while guiding the electric column 260 and sensor column 264 into the centrally-recessed, rounded form of the electrode pads 259, 262*a*. As a result, elasticity can be maintained by applying a preload to the electric wires (electric column 260, sensor column 264).

Although not shown in the drawings, an insulating and protecting film is formed on the parts of the piezoelectric element 258, diaphragm 256, and electric wires (electric column 260, sensor column 264) within the common liquid chamber 255 which contact the ink.

Next, a manufacturing method for the print head 250 will be described following the flowchart in FIG. 14.

Figure 14:
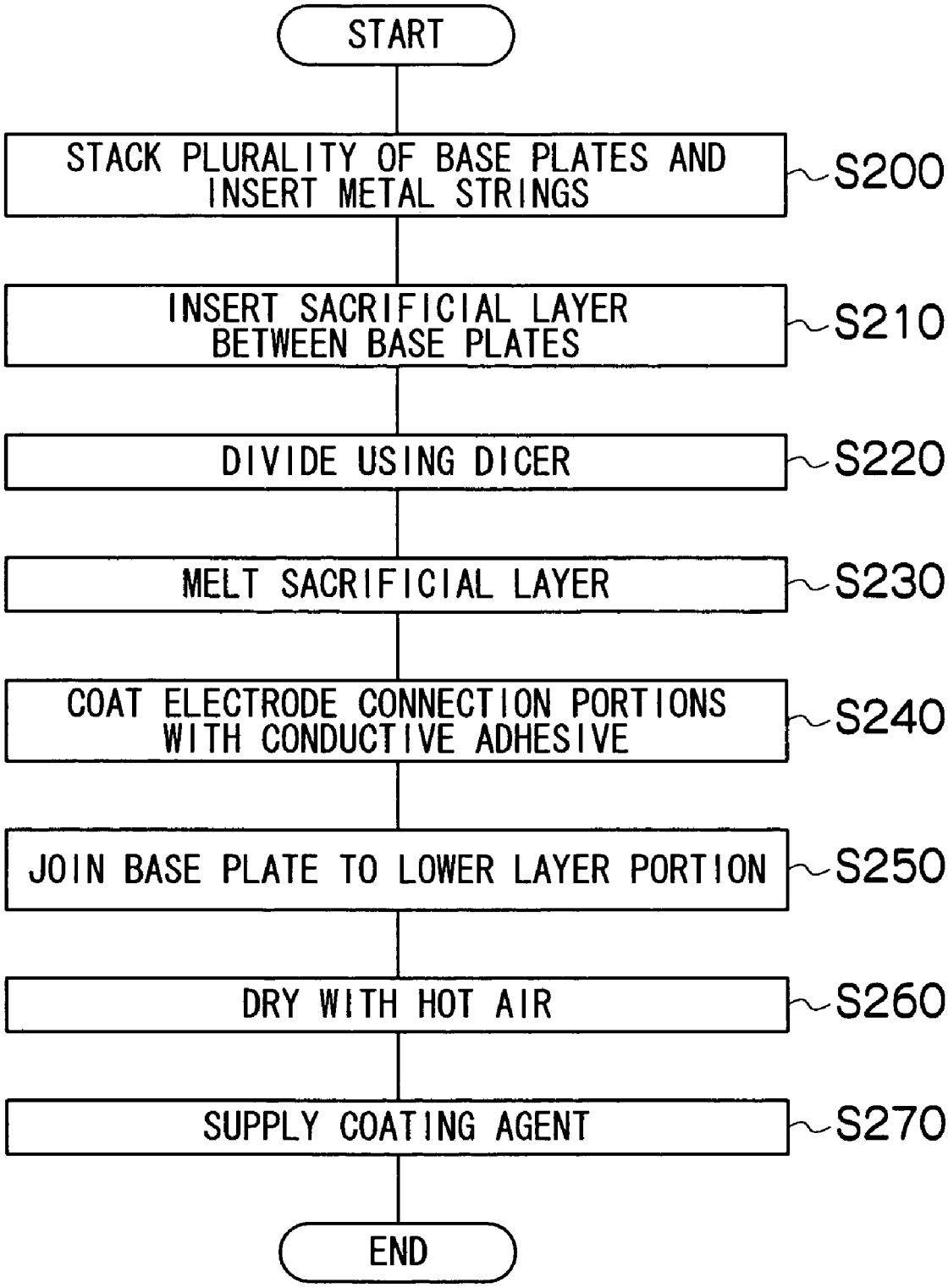
FIG. 14 is a flowchart showing a manufacturing method for the print head of this embodiment.

FIG. 14 is a flowchart showing in sequence a manufacturing method for the print head 250 according to this embodiment. First, in a step S200 in FIG. 14, a plurality of base plates having holes formed in the positions for forming the electric wires (electric column 260, sensor column 264) are stacked at predetermined intervals and held, and a metal string (conductive wire) is passed through each hole. Insulation processing is implemented on the interior of the holes before inserting the metal strings. The sectional form of the metal strings does not have to be circular, and may take an elongated form in the ink flow direction to enhance the air bubble-removing property. For example, the cross-section of the metal strings may take a substantially rectangular form having rounded corner portions (or an elliptical form). The ratio of the long side to the short side (or the long axis and short axis) of the cross-section of the metal strings is preferably set to no less than 1.1.

Figure 15:
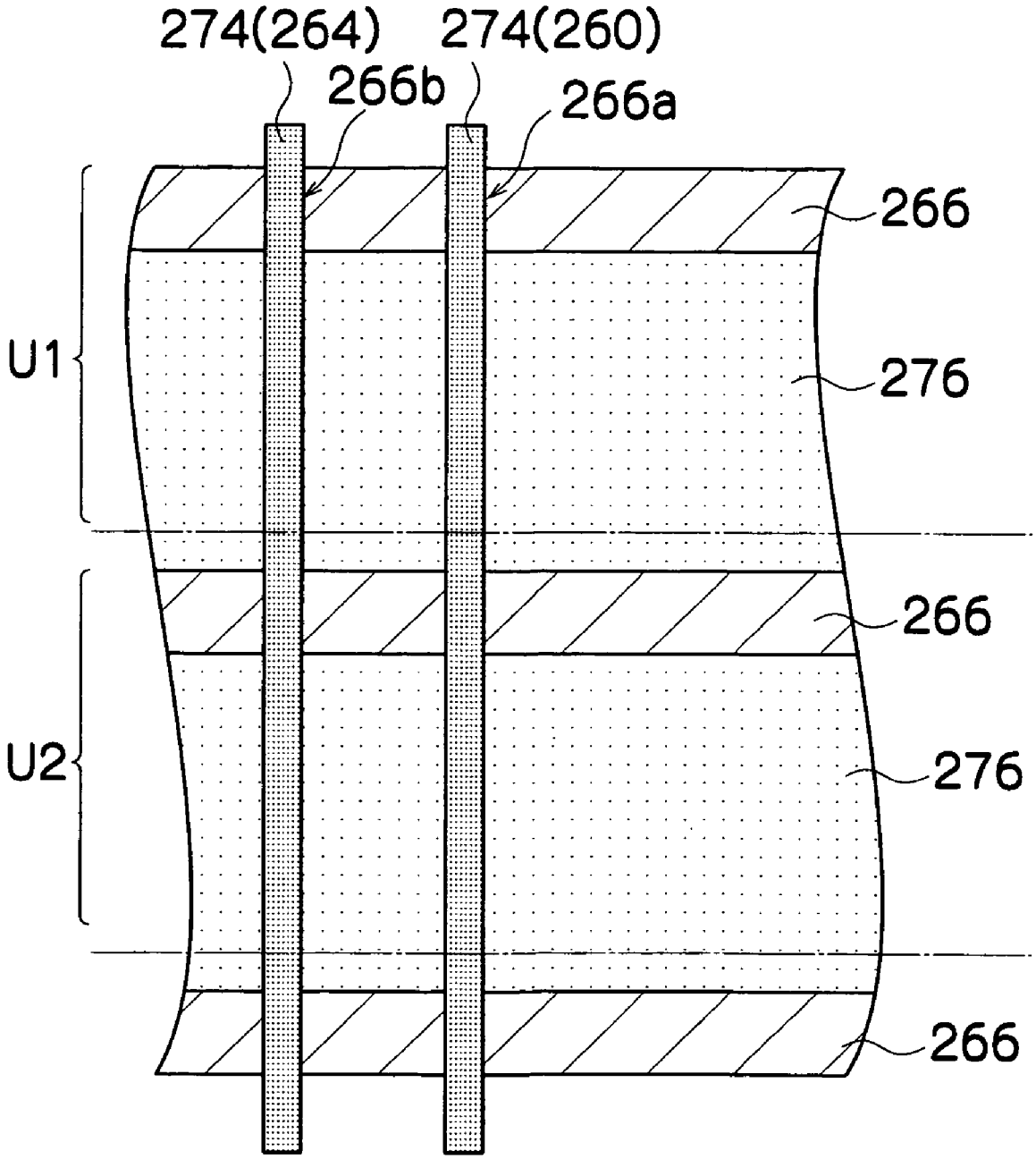
FIG. 15 is a sectional view showing a state in which metal strings are passed through a base plate and sacrificial layers are formed in the print head manufacturing method of this embodiment.

Next, in a step S210, an adhesive is applied between the base plates held in stacked form at predetermined intervals in order to fix the metal strings. Wax is then filled into the gaps to form a sacrificial layer. FIG. 15 shows the wax inserted between the base plates as a sacrificial layer. As shown in FIG. 15, base plates 266 are held at predetermined intervals, and metal strings 274 serving as the respective electric wires (electric column 260, sensor column 264) are passed through holes 266*a*, 266*b* for forming the electric wires. Wax is then filled into the gaps between the base plates 266 to form sacrificial layers 276.

Next, in a step S220, cuts are made in a predetermined position parallel to the base plates 266 using a dicer, as shown by the dot/dash line in FIG. 15. Here, if dicing is performed such that the metal strings 274 also protrude from the upper side of the base plates 266 (on the opposite side to the piezoelectric element that is connected at a later stage), it becomes easier to connect the metal strings 274 to the multi-layer flexible cable. Next, in a step S230, the sacrificial layers 276 are removed from the cut parts by melting, as shown by the reference symbols U1, U2 in FIG. 15.

Next, in a step S240, the multi-layer flexible cable is joined to the upper side of the component constituted by the base plates 266 from which the sacrificial layers 276 have been removed and through which the metal strings 274 pass, thereby forming an upper layer portion of the print head 250. An electrode connection portion of a separately-formed lower layer portion of the print head 250, including the pressure chamber and so on, is then coated with a conductive adhesive in preparation for joining.

Further, since the length of the electric column 260 and sensor column 264 differ at the time of joining, the lengths are aligned prior to joining. There are no particular limitations on the method employed, and for example, the electric column 260 and sensor column 264 may be subjected to polishing or the like prior to removal of the sacrificial layer so that their lengths are aligned, or during cutting with the dicer, the part of the electric column 260 and the part of the sensor column 264 may be cut in different positions.

Next, in a step S250, an upper layer portion U of the print head 250, including the base plate 266, is joined to a lower layer portion L of the print head 250, including the pressure chamber 252, as shown in FIG. 13.

At this time, the tip end portion of the electric column 260 is joined to the electrode pad 259, and the tip end portion of the sensor column 264 is joined to the electrode pad 262*a*. As described above, the electrode pads 259, 262*a* are each set in a bowl form so that the electric column 260 and sensor column 264 can be guided easily and positioned with good precision. Furthermore, a relief structure (relief portions 270, 272) is formed on the lower side of each electrode joining portion to alleviate joining pressure and maintain elasticity by applying a preload to the electric wires (electric column 260, sensor column 264). As a result, the connection is stabilized.

Next, in a step S260, the conductive adhesive is dried by means of hot-air drying. In a final step S270, a coating agent is supplied to the interior of the common liquid chamber 255 and so on for insulation and protection. The ink circulation and supply system of the print head 250 is preferably used to supply the hot air and coating agent.

According to this embodiment, a plurality of base plates are stacked, metal strings are passed through the base plates, and the resulting component is cut. As a result, a large number of electric wires having the same shape can be formed at once, enabling an improvement in production efficiency.

Note that instead of connecting the metal strings 274 to the electrode connection portion using a conductive adhesive, solder or the like may be applied to the electrode connection portion and heated to fuse the electrode connection portion to the metal strings 274.

Next, a third embodiment of the present invention will be described.

In the second embodiment described above, the columnar electric wires (electric column 260, sensor column 264) pass directly through the common liquid chamber 255 as shown in FIG. 13, but in the third embodiment, partition walls which divide the common liquid chamber into a plurality of tributaries are formed by a laminated layer substrate, whereupon metal strings are passed through the partition walls and then cut to form similar columnar electric wires. Since the electric wires are formed in the partition walls of the laminated common liquid chamber in this embodiment, the strength of the wires can be improved.

Figure 16:
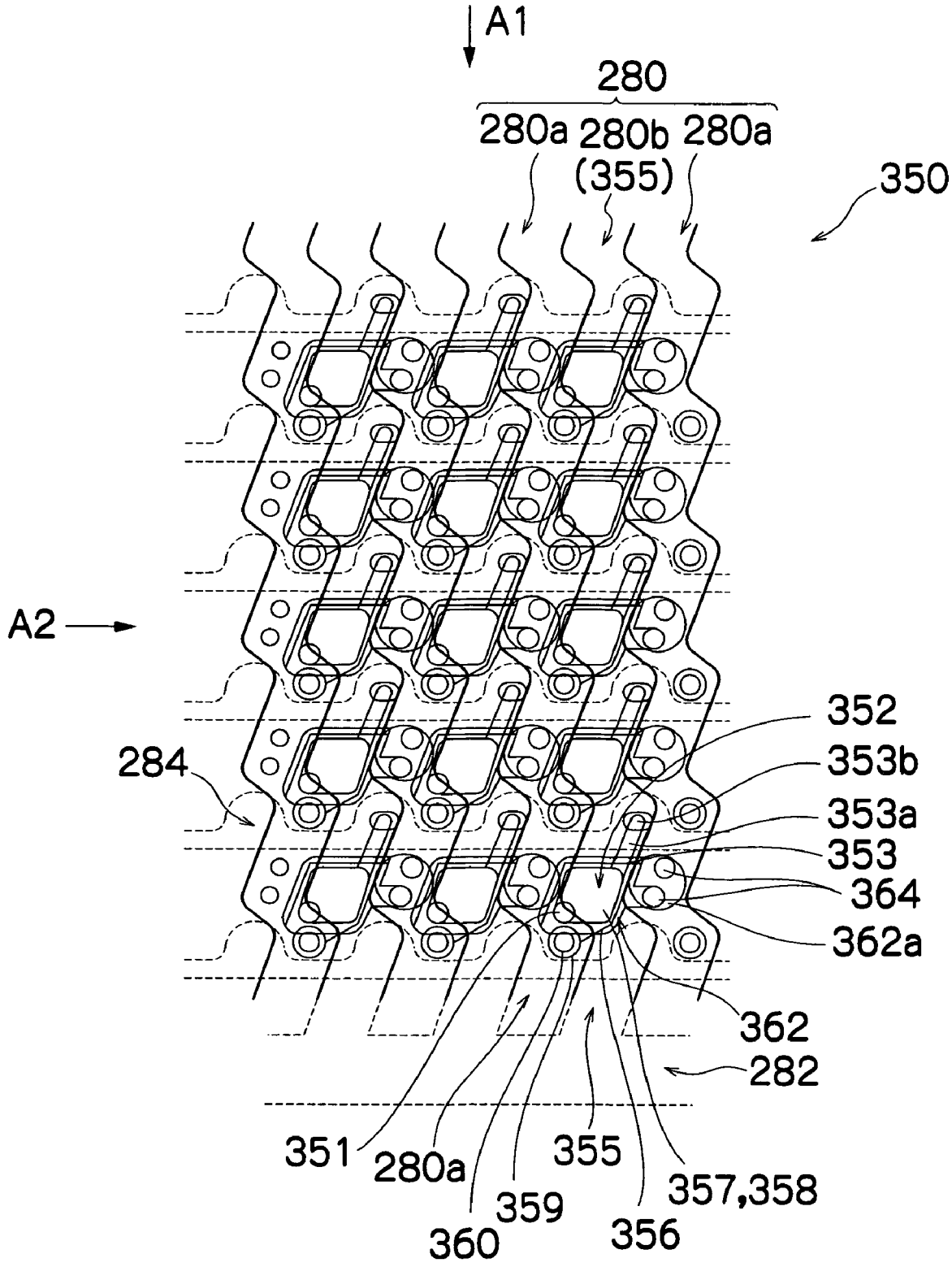
FIG. 16 is a projected, enlarged plan view showing a part of a print head according to a third embodiment of the present invention.

FIG. 16 is an enlarged projected plan view showing a part of a print head 350 according to this embodiment.

The print head 350 of this embodiment is formed by laminating together a large number of various types of plate materials.

As shown in FIG. 16, in the print head 350, parallelogram-form pressure chambers 352 having a nozzle 351 and a supply port 353 are arranged in series in a staggered, two-dimensional matrix form. A surface (ceiling face) of the pressure chamber 352 opposing the surface (bottom face) formed with the nozzle 351 is constituted by a diaphragm 356 which doubles as a common electrode. A piezoelectric body 358 is formed on the diaphragm 356 in a form which corresponds to the form of the pressure chamber 352, and an individual electrode 357 is formed on the piezoelectric body 358.

A wire is drawn out from the individual electrode 357 to the outside of the pressure chamber 352 from the side end portion of the nozzle 351, and forms an electrode pad 359 which serves as an electrode connection portion. A columnar electric wire (electric column) 360 is formed substantially perpendicular to (the attachment surface of) the piezoelectric element 358 so as to stand upright from the electrode pad 359.

To form the columnar electric wire 360, flow passage plates 280, constituted by a plurality of narrow, strip-form beam portions 280*a* extending in wave form in the vertical direction of the drawing and connected at both ends (although the ends are not shown in the drawing), are laminated together. The spaces between the beam portions 280*a* that are formed by laminating together the flow passage plates 280 form tributaries 280*b* dividing a common liquid chamber 355 for supplying each pressure chamber 352 with ink. By laminating together the beam portions 280*a*, partition walls are formed between the tributaries 280*b* serving as the common liquid chamber 355, and the columnar electric wires (electric columns) 360 are formed so as to pass through these partition walls.

Further, an ink flow passage 353*a* extends from the ink supply port 353 formed in one corner of the pressure chamber 352, and a supply restrictor 353*b* which receives the supply of ink from the sub flow 280*b* (common liquid chamber 355) is formed at the tip end of the ink flow passage 353*a*. Although shown only in the lower section of the drawing by a broken line, the two ends of the sub flow 280*b* (at the top and bottom of the drawing) are connected to a main flow 282 of the ink supply flow passage, extending in the left/right direction of the drawing. Ink is supplied into the main flow 282 of the ink supply flow passage from an ink tank, not shown in the drawing, and then supplied from the main flow 282 to each sub flow 280*b*. From the sub flow 280*b*, the ink is supplied through the ink supply port 353 to the pressure chamber 352 via the supply restrictor 353*b* provided for each pressure chamber 352.

A sensor plate 362 for determining the ink ejection state by measuring the internal pressure of the pressure chamber 352 is disposed on the lower side of the pressure chamber 352, and an electrode pad 362*a* is formed on the part of the sensor plate 362 on the outside of the pressure chamber 352. An electric wire (sensor column) 364 for extracting measurement signals from the sensor plate 362 is provided in an upright manner substantially perpendicular to the sensor plate 362, similarly to the electric column 360 described above.

The structure of these laminated layers forming the print head 350 will be described in detail below. Note, however, that a piezo cover 284 is disposed on the piezoelectric element 358 to cover the piezoelectric body 358 and thereby protect the piezoelectric body 358 from ink, to stabilize driving of the piezoelectric body 358 in isolation from the ink, and to provide a damping characteristic so that crosstalk is reduced.

Next, the structure of the laminated layers of the print head 350 will be described using FIGS. 17 and 18.

Figure 17:
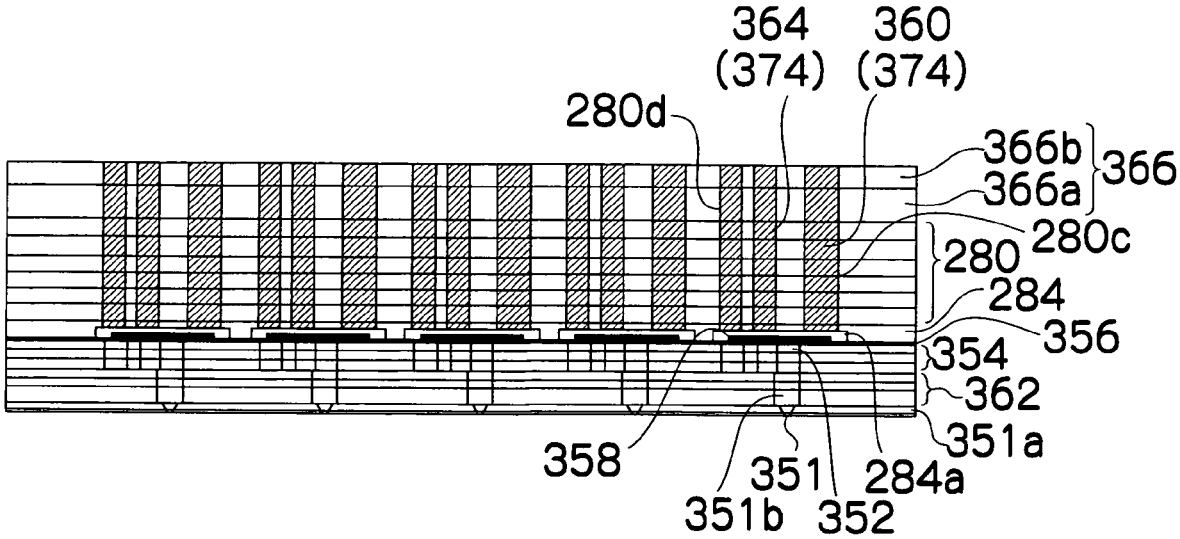
FIG. 17 is a projected side view of the print head shown in FIG. 16, seen from the direction of an arrow A1.
Figure 18:
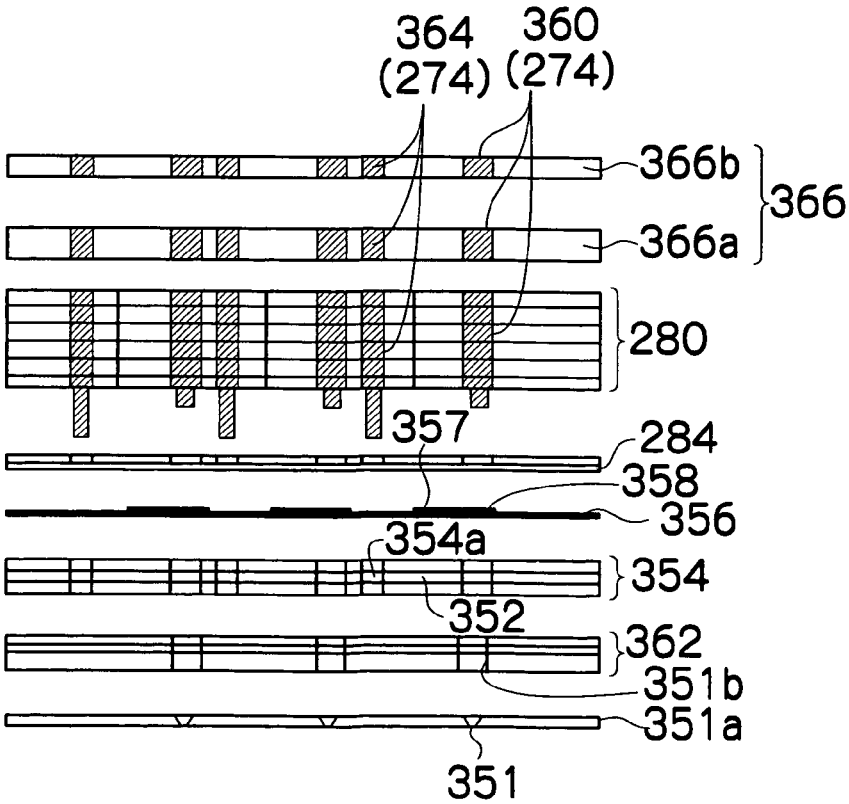
FIG. 18 is a projected, exploded side view of the print head shown in FIG. 16, seen from the direction of an arrow A2.

FIG. 17 is a projected side view of FIG. 16 seen from the direction of an arrow A1 in FIG. 16, and FIG. 18 is an exploded, projected side view of FIG. 16 seen from the direction of an arrow A2 in FIG. 16.

Referring to FIGS. 17 and 18, first, a nozzle plate 351*a* in which the nozzles 351 are formed is disposed on the lowest layer of the print head 350. The nozzle plate 351*a* is formed by half-cut pressing and polishing a stainless steel thin plate, through nickel electro forming, or by implementing liquid repellency processing on a substance such as a polyimide that has been subjected to abrasion using an exciter laser, for example. The nozzle 351 is formed in a reverse tapered form such that its diameter decreases steadily toward the ink ejection side (outside).

Next, the sensor plate 362 for measuring the pressure inside the pressure chamber 352 is laminated onto the nozzle plate 351*a*. A nozzle flow passage 351*b* connecting the pressure chamber 352 and nozzle 351 is formed in the sensor plate 362. The sensor plate 362 is formed by laminating PVDF onto stainless steel, for example. The electrode pad 362*a* (see FIG. 8) serving as a connection portion for forming a connection to the sensor column 364, or in other words the electric wire for extracting measurement signals, is formed to correspond to both the front and rear of the PVDF of the sensor plate 362.

A pressure chamber plate 354 which forms the pressure chamber 352 is laminated onto the sensor plate 362. The pressure chamber plate 354 is formed by subjecting stainless steel plates to multi-step etching or double-sided etching, and then laminating together these plates, for example. The pressure chamber plate 354 is formed with an opening serving as the pressure chamber 352 and supply restrictor 353*b*, and a through hole 354*a* for the sensor column 364. An adhesive escape groove (not shown in the drawing) or the like for allowing adhesive to escape so that excess adhesive does not run out during adhesion and block the pressure chamber 352 or supply restrictor 353*b* is formed as needed.

Next, the diaphragm 356 is laminated onto the pressure chamber plate 354 by epoxy adhesion or the like. The piezoelectric element 358 is then formed on the diaphragm 356 in a position corresponding to the pressure chamber 352. The piezoelectric element 358 employs a fired and polished plate formed with a common electrode by sputtering, and then subjected to mechanical separation. Further, although not shown in the drawing, a hole for the supply restrictor 353*b* and a hole for the sensor column 364 are formed in the diaphragm 356. The individual electrode 357 is formed on the piezoelectric element 358, and an electrode pad 359 (see FIG. 16) is drawn out of the individual electrode 357 onto an insulation layer.

Next, the piezo cover 284 is laminated onto the diaphragm 356 formed with the piezoelectric element 358. For example, the piezo cover 284 has a half-cut structure produced by subjecting a stainless steel thin plate to wet etching, and subjecting a part 284*a* corresponding to the position of the piezoelectric element 358 to half-etching in order to avoid the piezoelectric element 358 following lamination. Further, a hole for the supply port 353, and holes for the electric column 360 and sensor column 362 are formed in the piezo cover 284 (these holes are not shown in the drawing).

As described above, the part 284*a* of the piezo cover 284 corresponding to the position of the piezoelectric element 358 is subjected to half-etching in order to cover the piezoelectric element 358 and thereby protect the piezoelectric element 358 from ink, to stabilize driving of the piezoelectric element 358 in isolation from the ink, and to provide a damping characteristic so that crosstalk is reduced.

The flow passage plate 280, which is formed with cavity portions for the electric column 360 and sensor column 364, i.e. the columnar electric wires, and which forms the spaces for the tributaries 280*b* of the ink supply flow passage, is laminated onto the piezo cover 284. The flow passage plate 280 is formed by subjecting a stainless steel thin plate to wet etching, for example. As shown in FIG. 16, the flow passage plate 280 is formed into a single plate (not shown in the drawing) by arranging a large number of elongated strip-form beam portions 280*a* in series and connecting the beam portions 280*a* at both ends. The spaces between the beam portions 280*a* become the tributaries 280*b* (common liquid chamber 355). Hence the common liquid chamber is formed on the opposite side of the pressure chamber 352 to the nozzle 351.

The flow passage plate 280 is also formed with a hole 280*c* for the electric column 360 and a hole 280*d* for the sensor column 364 in each beam portion 280*a*.

A plate 366*a* for sealing the main flow 282 and tributaries 280*b* is laminated onto the flow passage plate 280, and another plate 366*b* for sealing the main flow 282 is laminated onto the plate 366*a*. These two plates constitute a base plate 366. The plate 366*b* for sealing the main flow 282 may serve as a heater for controlling the overall temperature of the laminated plates. Further, the plates 366*a* and 366*b* are formed respectively with holes through which wires are passed to form the electric column 360 and sensor column 364.

The print head 350 has the laminated structure described above. As will be described below, a power board constituted by a multi-layer flexible cable packaged with a driver IC and the like is joined to the top of the print head 350.

A manufacturing method for the print head 350 will now be described.

First, holes for inserting the metal strings for the electric column 360 and sensor column 364 are opened in the flow passage plate 280 and the plates 366*a*, 366*b* constituting the base plate 366 for sealing the tributaries and main flow. The flow passage plate 280 and base plate 366 are then laminated together. Next, a plurality of the base plates 366 joined to flow passage plates 280 are held at predetermined intervals, metal strings (conductive wires) 374 are passed through, and wax is filled into the gaps between the base plates 366 to serve as a sacrificial layer 376.

Figure 19:
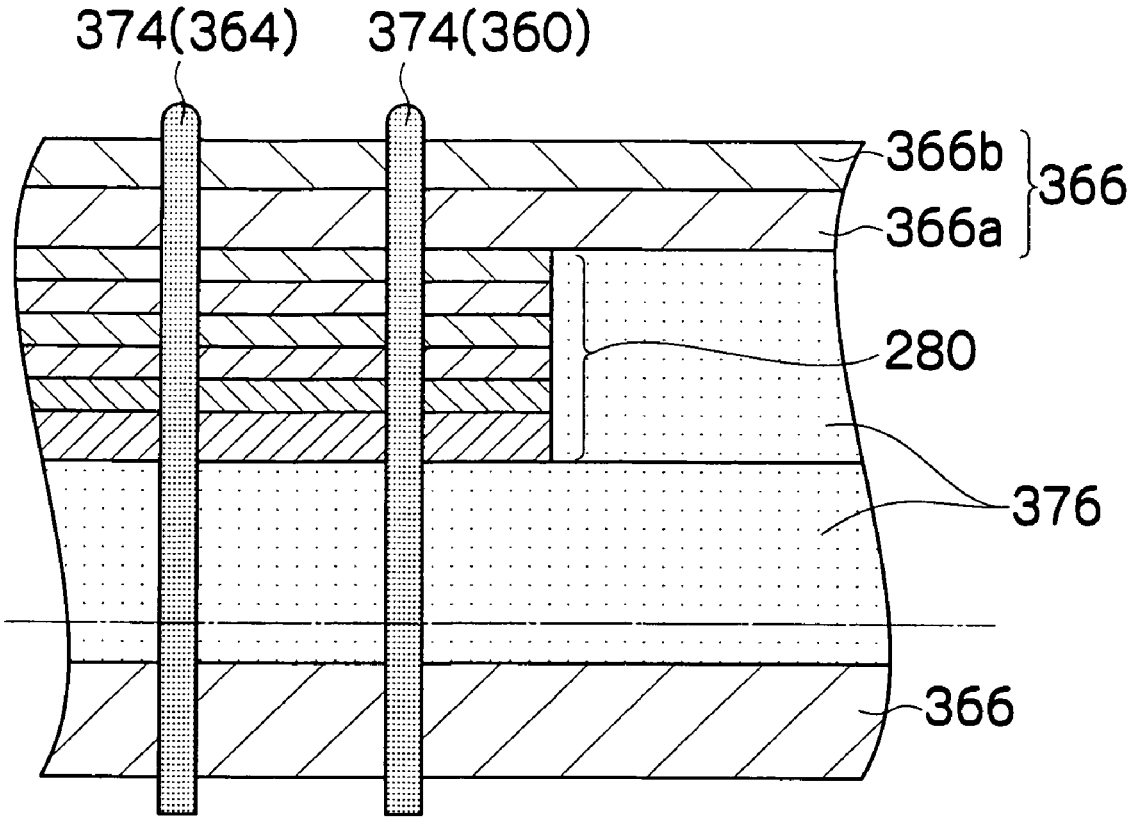
FIG. 19 is a sectional view showing a state in which a flow passage plate is joined to the base plate and the metal strings are passed therethrough.

FIG. 19 shows a state in which the base plates 366 and flow passage plates 280 are joined, the metal strings 374 are passed through, and the sacrificial layer 376 is formed in the gaps therebetween. Next, as shown by the dot/dash line in FIG. 19, the sacrificial layer 376 is cut parallel to the base plate 366 using a dicer. After this cutting, the sacrificial layer 376 is removed by melting as shown in FIG. 20.

Figure 20:
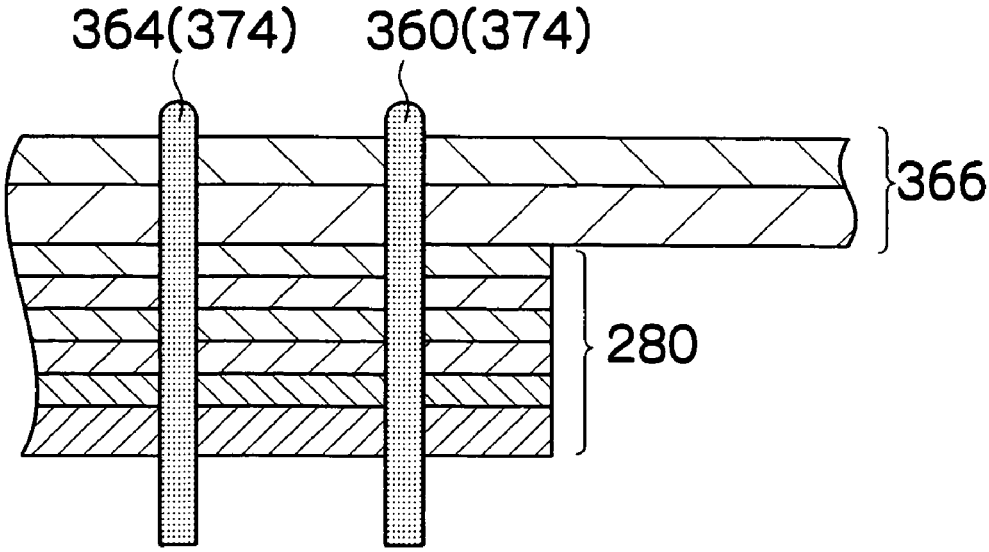
FIG. 20 is a sectional view showing a state in which the member shown in FIG. 19 is cut and the sacrificial layer is removed.
Figure 21:
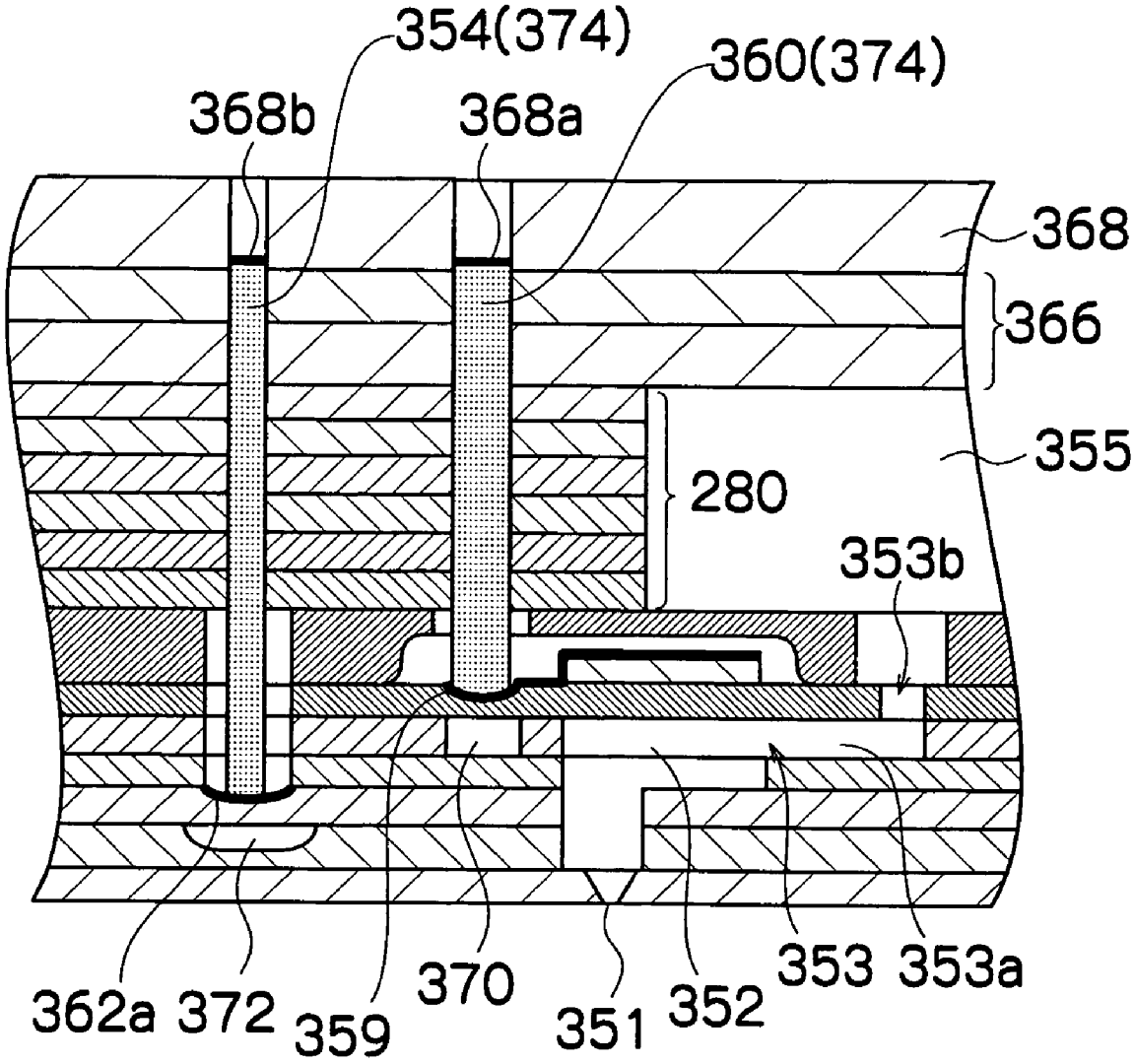
FIG. 21 is an enlarged sectional view showing a part of the print head according to the third embodiment.

Next, the upper layer portion of the print head 350, formed as shown in FIG. 20, is joined to the separately-formed lower layer portion of the print head 350, constituted by the pressure chamber 352 and so on, as shown in FIG. 21.

As shown in FIG. 21, the metal string 374 serving as the electric column 360 is adhered to the electrode pad 359 that is drawn out from the individual electrode 357 on the piezoelectric element 358, and the metal string 374 serving as the sensor column 364 is adhered to the electrode pad 362*a* formed on the sensor plate 362.

At this time, the part of the electrode pad 359 to which the metal string 374 serving as the electric column 360 is adhered and the part of the electrode pad 362*a* to which the metal string 374 serving as the sensor column 364 is adhered take a rounded shape (bowl shape) with a recessed center, as shown in FIG. 21, and therefore self-alignment is possible, positioning and guiding can be performed easily, and adhesion can be performed securely and with good precision.

Moreover, at this time the pressure chamber plate 354 on the lower side of the electrode pad 359, which is adhered to the metal string 374 serving as the electric column 360, is formed with an opening 370 (relief portion). Similarly, a relief portion 372 is formed by half-etching in the sensor plate 362 on the lower side of the electrode pad 362*a* to which the metal string 374 serving as the sensor column 364 is adhered.

By forming these relief structures on the respective opposing surfaces of the extracted electrodes (electric column 360 and sensor column 364) serving as columnar electric wires, the joining pressure generated when the metal strings 374, 374 are connected to the electrodes 359, 362*a* can be alleviated while guiding the tip ends of the metal strings 374, 374 into the centrally-recessed, rounded form of the electrode pads 359, 362*a*, and hence elasticity can be maintained by applying a preload to the extracted electrodes, thereby stabilizing the connection.

Finally, a multi-layer flexible cable 368 is mounted on the base plate 366, and thus the print head 350 shown in FIG. 21 is formed. In this embodiment, metal strings are passed through partition walls of the common flow passage and then cut to form the electric wires, and hence a large number of electric wires can be formed simultaneously and efficiently. Moreover, the strength of the columnar electric wires can be improved.

The liquid ejection head and liquid ejection head manufacturing method of the present invention have been described in detail above, but the present invention is not limited to the above examples, and may of course be subjected to various improvements and modifications within a scope that does not depart from the spirit of the present invention.

What is claimed is:

1. A liquid ejection head, comprising:

a plurality of ejection ports which eject liquid;

a plurality of pressure chambers which communicate respectively with the plurality of ejection ports, each pressure chamber including a bottom surface that is opposed by an overlying ceiling surface with the bottom surface of each pressure chamber including one of the plurality of ejection ports;

the overlying ceiling surface of each pressure chamber being a part of a common diaphragm facing the bottom surface on which the ejection ports are formed;

a plurality of piezoelectric elements respectively provided on each part of the common diaphragm facing the bottom surface on which the ejection ports are formed so that a piezoelectric element is positioned over each pressure chamber facing the bottom surface on which the ejection ports are formed, each piezoelectric element deforming an associated part of the common diaphragm to deform each associated pressure chamber to eject liquid from the associated ejection port on the associated bottom surface;

a common liquid chamber which supplies the liquid to the plurality of pressure chambers that is formed adjacent to each respective one of the piezoelectric elements above the pressure chambers; and a plurality of electric wires which stand upright from and substantially perpendicular to a surface of each part of the common diaphragm on which the piezoelectric elements are mounted, the electric wires passing through a partition wall of the common liquid chamber and being electrically connected to the piezoelectric elements, the electric wires being formed by inserting wiring material for forming the electric wires into holes provided in the partition wall of the common liquid chamber.

2. The liquid ejection head as defined in claim 1, wherein the electric wires are formed by applying pressure to the wiring material stacked on a member forming the partition wall of the common liquid chamber, in order to insert the wiring material into the holes.

3. The liquid ejection head as defined in claim 1, wherein a connection portion of the piezoelectric element which is electrically connected to the electric wire takes a recessed form.

4. The liquid ejection head as defined in claim 3, wherein a space is formed on a side of the connection portion opposite to the electric wire.

5. An image forming apparatus, comprising the liquid ejection head as defined in claim 1.

6. The liquid ejection head as defined in claim 1, further comprising:

an individual electrode formed on each piezoelectric element, wherein each individual electrode extends outside of each respective pressure chamber and forms an electrode pad, each of the plurality of electric wires connects to a corresponding electrode pad, and a part of the electrode pad to which a corresponding electric wire connects has a rounded shape with a recessed center.

7. A liquid ejection head, comprising:

a plurality of ejection ports which eject liquid;

a plurality of pressure chambers which communicate respectively with the plurality of ejection ports, each pressure chamber including a bottom surface that is opposed by an overlying ceiling surface with the bottom surface of each pressure chamber including one of the plurality of ejection ports;

the overlying ceiling surface of each pressure chamber being a part of a common diaphragm provided facing the bottom surface on which the ejection ports are formed;

a plurality of piezoelectric elements respectively provided on each part of the common diaphragm facing the bottom surface on which the ejection ports are formed so that a piezoelectric element is positioned over each pressure chamber facing the bottom surface on which the ejection ports are formed, each piezoelectric element deforming an associated part of the common diaphragm to deform each associated pressure chamber to eject liquid from the associated ejection port on the associated bottom surface;

a common liquid chamber which supplies the liquid to the plurality of pressure chambers that is formed adjacent to each respective one of the piezoelectric elements above the pressure chambers; and a plurality of electric wires which stand upright from and substantially perpendicular to a surface of each part of the common diaphragm on which the piezoelectric elements are mounted, the electric wires passing through a partition wall of the common liquid chamber and being electrically connected to the piezoelectric elements, the electric wires being formed of metal strings.

8. The liquid ejection head as defined in claim 7, wherein the electric wires are formed by passing the metal strings through holes provided in a plurality of base plates stacked at a predetermined interval with a sacrificial layer inserted therebetween, cutting the metal strings in a predetermined position on a plane substantially parallel to the base plates, and removing the sacrificial layer.

9. The liquid ejection head as defined in claim 7, wherein a connection portion of the piezoelectric element which is electrically connected to the electric wire takes a recessed form.

10. The liquid ejection head as defined in claim 9, wherein a space is formed on a side of the connection portion opposite to the electric wire.

11. An image forming apparatus, comprising the liquid ejection head as defined in claim 7.

12. The liquid ejection head as defined in claim 7, further comprising:

an individual electrode formed on each piezoelectric element, wherein each individual electrode extends outside of each respective pressure chamber and forms an electrode pad, each of the plurality of electric wires connects to a corresponding electrode pad, and a part of the electrode pad to which a corresponding electric wire connects has a rounded shape with a recessed center.

* * * * *